US009226539B2

(12) United States Patent
Beauchamp et al.

(10) Patent No.: US 9,226,539 B2
(45) Date of Patent: Jan. 5, 2016

(54) HELMET WITH RIGID SHELL AND ADJUSTABLE LINER

(75) Inventors: Pierre-Luc Beauchamp, St-Hippolyte (CA); Sebastien Morin, St-Jerome (CA); Philippe Valiquette, Laval (CA)

(73) Assignee: SPORT MASKA INC., Montreal, Quebec ( * ) Notice: Subject to any disclaimer, the term of this patent is extended or adjusted under 35 U.S.C. 154(b) by 292 days.

(21) Appl. No.: 12/835,101

(22) Filed: Jul. 13, 2010

(65) Prior Publication Data

US 2012/0011639 A1 Jan. 19, 2012

(51) Int. Cl.
*A42B 3/24* (2006.01)
*A42B 3/32* (2006.01)

(52) U.S. Cl.
CPC ..... *A42B 3/324* (2013.01)

(58) Field of Classification Search
CPC ..... A42B 3/24
USPC ..... 2/6.8, 411, 412, 414, 417, 422, 425
See application file for complete search history.

(56) References Cited

U.S. PATENT DOCUMENTS

| | | | | |
|---|---|---|---|---|
| 3,116,490 | A * | 1/1964 | Zbikowski | 2/414 |
| 3,362,403 | A | 1/1968 | Fleming et al. | |
| 3,364,499 | A * | 1/1968 | Kwoka | 2/414 |
| 3,500,475 | A * | 3/1970 | Otsuka | 2/421 |
| 3,820,163 | A | 6/1974 | Rappleyea | |
| 4,006,496 | A | 2/1977 | Marker | |
| 4,404,690 | A | 9/1983 | Farquharson | |
| 4,477,929 | A | 10/1984 | Mattsson | |
| 4,586,200 | A | 5/1986 | Poon | |
| 4,627,114 | A * | 12/1986 | Mitchell | 2/414 |
| 4,646,367 | A * | 3/1987 | El Hassen | 2/411 |
| 4,704,746 | A | 11/1987 | Nava | |

(Continued)

FOREIGN PATENT DOCUMENTS

| | | |
|---|---|---|
| CA | 51003 | 3/1983 |
| CA | 1217601 A1 | 2/1987 |

(Continued)

OTHER PUBLICATIONS

"Sportscope Flex-Fit Bicycle Helmets: Gold, Consumer Products", Retrieved from the Internet <URL: http://idsa.org/idea2000/G7720.htm>, Retrieved May 21, 2008, Industrial Designers Society of America.

(Continued)

*Primary Examiner* — Shaun R Hurley
*Assistant Examiner* — Andrew W Sutton
(74) *Attorney, Agent, or Firm* — Norton Rose Fulbright Canada

(57) ABSTRACT

A helmet has a rigid shell and an adjustable liner connected to the shell. The liner has a plurality of pads located in the shell cavity. The pads are movable with respect to the interior shell surface between a first position near the interior shell surface and a second position further away. In some embodiments, pads are biased towards their second position and the act of the wearer inserting his head into the helmet causes the pads to move towards their first position while remaining biased against the head of the wearer to assist in causing the liner to conform to the head of the wearer. In other embodiments, constriction of the pads moves pads from their second position to their first position, for this same purpose. In other embodiments, pads having both of the aforementioned characteristics are present.

22 Claims, 28 Drawing Sheets

(56) References Cited

U.S. PATENT DOCUMENTS

| | | | | |
|---|---|---|---|---|
| 4,916,759 | A | 4/1990 | Arai | |
| 5,511,250 | A | 4/1996 | Field et al. | |
| 5,669,079 | A | 9/1997 | Morgan | |
| 5,815,847 | A * | 10/1998 | Holden, Jr. | 2/418 |
| 5,943,706 | A | 8/1999 | Miyajima et al. | |
| 6,032,300 | A | 3/2000 | Bainbridge et al. | |
| 6,108,824 | A | 8/2000 | Fournier et al. | |
| 6,154,889 | A | 12/2000 | Moore, III et al. | |
| 6,226,801 | B1 | 5/2001 | Alexander et al. | |
| 6,240,571 | B1 | 6/2001 | Infusino | |
| 6,256,798 | B1 * | 7/2001 | Egolf et al. | 2/421 |
| 6,298,497 | B1 | 10/2001 | Chartrand | |
| 6,324,700 | B1 | 12/2001 | McDougall | |
| 6,385,780 | B1 | 5/2002 | Racine | |
| 6,453,476 | B1 | 9/2002 | Moore, III | |
| 6,619,751 | B1 | 9/2003 | Shah | |
| 6,665,884 | B1 | 12/2003 | Demps et al. | |
| 6,777,062 | B2 | 8/2004 | Skaja | |
| 6,865,752 | B2 * | 3/2005 | Udelhofen et al. | 2/425 |
| 6,925,657 | B2 | 8/2005 | Takahashi et al. | |
| 6,968,575 | B2 | 11/2005 | Durocher | |
| 6,981,284 | B2 | 1/2006 | Durocher | |
| 7,240,376 | B2 | 7/2007 | Ide et al. | |
| 7,634,820 | B2 | 12/2009 | Rogers et al. | |
| 7,673,351 | B2 | 3/2010 | Copeland et al. | |
| 7,735,157 | B2 | 6/2010 | Ikeda | |
| 2001/0032351 | A1 | 10/2001 | Nakayama et al. | |
| 2006/0059606 | A1 | 3/2006 | Ferrara | |
| 2006/0112477 | A1 | 6/2006 | Schneider | |
| 2006/0206994 | A1 | 9/2006 | Rogers et al. | |
| 2007/0056081 | A1 | 3/2007 | Aspray | |
| 2007/0079429 | A1 | 4/2007 | Pilon et al. | |
| 2007/0157370 | A1 | 7/2007 | Joubert Des Ouches | |
| 2007/0199136 | A1 | 8/2007 | Brine, III et al. | |
| 2007/0209098 | A1 | 9/2007 | Peart | |
| 2007/0245468 | A1 | 10/2007 | Butler | |
| 2007/0266481 | A1 | 11/2007 | Alexander et al. | |
| 2007/0266482 | A1 | 11/2007 | Alexander et al. | |
| 2008/0092279 | A1 * | 4/2008 | Chiang | 2/425 |
| 2010/0180362 | A1 * | 7/2010 | Glogowski et al. | 2/411 |

FOREIGN PATENT DOCUMENTS

| | | | |
|---|---|---|---|
| CA | 81172 | | 7/1997 |
| CA | 75165 | | 11/1997 |
| CA | 2191678 | | 5/1998 |
| CA | 2191694 | | 5/1998 |
| CA | 2274513 | | 12/1999 |
| CA | 2260549 | | 8/2000 |
| CA | 2291907 | A1 | 12/2000 |
| CA | 93840 | | 11/2001 |
| CA | 2357690 | A1 | 3/2003 |
| CA | 2365894 | A1 | 6/2003 |
| CA | 2414872 | A1 | 6/2003 |
| CA | 101791 | | 12/2003 |
| CA | 2495016 | A1 | 2/2004 |
| CA | 2401929 | A1 | 3/2004 |
| CA | 2432622 | A1 | 12/2004 |
| CA | 2437545 | A1 | 2/2005 |
| CA | 2437626 | A1 | 2/2005 |
| CA | 2191683 | | 3/2005 |
| CA | 2345085 | | 4/2005 |
| CA | 2290324 | | 5/2005 |
| CA | 2321399 | | 7/2005 |
| CA | 2573639 | A1 | 1/2006 |
| CA | 2573640 | A1 | 1/2006 |
| CA | 2263384 | | 6/2006 |
| CA | 2091936 | | 7/2006 |
| CA | 2598015 | A1 | 8/2006 |
| CA | 2295346 | | 12/2006 |
| CA | 2561540 | A1 | 3/2007 |
| CA | 2533493 | A1 | 7/2007 |
| CA | 2574151 | A1 | 7/2007 |
| WO | 0051456 | A1 | 9/2000 |

OTHER PUBLICATIONS

Easton Hockey Catalog, 2008, pp. 38-39-40-41-78-79-80-81.

* cited by examiner

HELMET WITH RIGID SHELL AND ADJUSTABLE LINER

FIELD OF THE INVENTION

The present invention relates to helmets having rigid shells and adjustable liners.

BACKGROUND OF THE INVENTION

Helmets assist in protecting the heads of those engaged in physical activities during which their heads are exposed to an elevated risk of injury. Amongst such activities are various sports such as ice hockey, football, baseball, rock climbing, rafting, motorcycling, etc. During many of these activities, participants (be they players, and in some cases, referees) are at risk of receiving impacts to their heads from many sources, including other participants, equipment used in the sport (for example, pucks and ice hockey sticks in case of ice hockey), or with the environment (for example, the ice or boards of an ice hockey rink, again, in case of ice hockey). Depending on the sport, and the type and the severity of these impacts, such impacts could result in injury to a participant's head. Helmets are designed to lower the risk of such impacts causing such injuries by spreading the energy of the impact over a larger surface area and by diminishing the amount of the energy which would otherwise had have to have been absorbed by the wearer's head had the wearer not been wearing the helmet. Thus, when wearing a helmet the likelihood of injury to the head of the wearer is reduced.

Typical conventional protective helmets are often designed to protect the frontal, the left temporal, the right temporal, the parietal and the occipital portions of the wearer's head. Thus, a typical such helmet has a rigid shell that surrounds these various portions of the wearer's head. The shell has a cavity therein for receiving the head of the wearer. In many conventional helmet designs, such as many ice hockey helmet designs, the rigid shell of the helmet is assembled from two separately molded plastic parts. These two parts are often adjustable one with respect to the other to reduce or enlarge the cavity within the shell for receiving the head of the wearer. This adjustability helps to provide a general overall proper fit to the helmet such that when the helmet is being worn, the shell covers the majority of the above-noted head portions and remains in place during game play.

In addition to their protective aspects, helmets must also be comfortable enough to be worn by the player throughout a game and not to unduly distract or disturb his attention during that time. Helmets obviously only provide protection when they are worn, so a certain minimum level of comfort is required to help ensure that people wear them.

One conventional way of achieving this comfort is to have a liner (typically, although not always, with various pads) attached inside the cavity of the helmet such that when a person wears the helmet the liner is disposed between the shell and the wearer's head. (Depending on its design, the liner may also play a shock-absorbing role as well, such that when the shell of the helmet receives an impact for example, the energy from this impact is at least partially absorbed by the deformation of the liner.) However, while the addition of such liners has assisted in rendering conventional helmets more comfortable to the wearer than those without, the comfort level provided by such liners is not optimal.

One possible way of improving the comfort level provided by a liner is to have the liner be adjustable to have it better conform to the head of the wearer. Typical conventional ways of adjusting such liners include both allowing the liner itself to deform and/or disposing liner adjustment mechanisms on or within the shell. Such conventional liner adjustment mechanisms typically move the liner (or portions thereof) towards or away from a particular portion of the head of the wearer under the control of the wearer. Various such adjustment mechanisms are conventionally known, but they are not without their drawbacks. In particular, a helmet cannot have too many of such mechanisms as they can (depending on their type and construction) make the helmet bulky and heavy. Further, these mechanisms tend to increase the complexity, and consequently the cost, of the design and manufacture of the helmet. Finally, notwithstanding the presence of such mechanisms, many wearers still feel that helmets should be more comfortable.

Another important design characteristic that must be taken into account is that the liner should not unnecessarily impede heat transfer from the wearer's head to the environment or external air ventilation of the wearer's head. Having multiple such conventional liner adjustment mechanisms can tend to worsen (or at least not improve) the heat transfer and ventilation aspects of conventional helmets.

Thus, helmet manufacturers (and in particular hockey helmet manufacturers) have come up with many conventional helmet designs in an attempt to balance all of these design characteristics. While many of these helmets may have provided a required degree of protection, none have been optimal in the area of comfort. There remains room for improvement in the art of helmet design, particularly as helmet liners and helmet comfort are concerned.

SUMMARY OF THE INVENTION

It is thus an object of the present invention to provide a helmet with an improved liner as compared with at least some conventional designs.

It is thus a further object of the present invention to provide a helmet with a more comfortable design for helmet wearers as compared with at least some conventional designs.

Therefore, in a first aspect, as embodied and broadly described herein, the present invention provides a helmet having a rigid shell and an adjustable liner connected to the shell. The shell has an interior shell surface defining a cavity within the shell for receiving a head of a wearer of the helmet. The shell also has an upper shell portion covering at least a majority of a frontal portion and parietal portions of the head of the wearer when the helmet is being worn. The adjustable liner includes a first plurality of floating pads located in the cavity in juxtaposition with the upper shell portion of the helmet. Each of the first plurality of floating pads is movable with respect to the interior shell surface between a first position near the interior shell surface and a second position further away from the interior shell surface than the first position.

In some embodiments some, and in some embodiments all, of the first plurality of floating pads are biased towards their second position with an amount of force that can be overcome by the wearer inserting his head into the helmet. The act of the wearer inserting his head into the helmet causes some, if not all, of the first plurality of floating pads to move from their second position towards their first position while, for those that are biased as described above, remaining biased against the head of the wearer to assist the liner in conforming to the head of the wearer while supporting the helmet on the head of the wearer.

The present inventors have realized that at least part of the reason why there may have been difficulty with conventional helmets in the prior art is that the liner adjustment mechanisms that such helmets used to conform to the head of the wearer were not designed so as to simply and adequately take into account the large variety of sizes and shapes of the heads of potential wearers and the individuality thereof with respect to any particular person. Thus, the comfort of such helmets could be improved, at least with respect to some individuals, if this were, at least partially, the case. Hence, helmets of this aspect of the present invention have an improved design so as to allow for enhanced conformity to the particular shape of any given individual wearer's head, at least in a part of the upper shell portion of the helmet. The action of (at least some of or all of—as the case may be) the plurality of first floating pads being individually displaced by the head of the wearer to various extents necessary to meet the size and shape of the wearer's head allows the liner to better conform to his head.

In the context of the first aspect of the present invention, the upper shell portion is the portion of the shell of the helmet covering at least a majority of a frontal portion and parietal portions of the head of the wearer when the helmet is being worn (by a wearer for whom the helmet is the correct size). It should be understood that (depending on the construction of any particular helmet at issue), given the variety of different helmet constructions, in the context of the first aspect of the present invention the upper shell portion of the shell may comprise a single physical structure, a portion of a single physical structure, multiple physical structures, or portions of multiple physical structures. Enhanced comfort in these regions of the helmet can add to a feeling of enhanced overall helmet comfort.

Similarly, in the context of the first aspect of the present invention, a floating pad need not be a completely separate physical structure, although it may be. Thus, a floating pad may comprise a material portion of a pad that is otherwise fixed if that material portion is free to move with respect to the inner shell surface as was described above. As was also described above, a floating pad may be biased towards a second position with an amount of force that can be overcome by the wearer inserting his head into the helmet and the act of the wearer inserting his head into the helmet causes the floating pad to move from the second position towards a first position while remaining biased against the head of the wearer to assist the liner in conforming to the head of the wearer while supporting the helmet on the head of the wearer. It should be understood however, no such bias is required by this aspect of the present invention for a pad to be considered a floating pad. A floating pad need have no bias at all.

Furthermore, in the context of the first aspect of the present invention, a floating pad should be understood to be located in juxtaposition with the upper shell portion of the helmet if a material portion of the pad is so located (irrespective of whether the entire pad is so located). Juxtaposition with the upper shell portion does not, however, require a particular size and/or shape for any particular pad, nor for the plurality of pads. It should also be understood that this aspect of the present invention is not limited to having floating pads in juxtaposition with the upper shell portion. Floating pads may be present in juxtaposition with other shell portions as well.

Finally, it should be understood that a first position near the interior shell surface includes first positions wherein the floating pad abuts the interior shell surface. Thus, in some embodiments, the helmet is supported on the head of the wearer at least by a portion of some of the first plurality of floating pads abutting the interior shell surface after their movement caused by the act of the wearer inserting his head into the helmet.

Preferably, each of the first plurality of floating pads is supported (i.e. is connected to the rest of the liner and is maintained in place) through a hinged connection and each hinged connection causes (i.e. is constructed to cause) the bias of its respective pad towards that pad's second position.

It should be understood that, in this aspect, the present invention does not require a linkage between the various floating pads of the first plurality of floating pads. However, it should also be understood that, in this aspect, the present invention does not require that such a linkage not be present either. Thus, the movement of any one individual floating pad from its first position towards its second position neither necessarily requires nor necessarily causes the movement of any other one of the first plurality of from its first position towards its second position. However, the movement of any one individual floating pad from its first position towards its second position may require and/or may cause the movement of another one (or ones) of the first plurality of from its (their) first position(s) towards its (their) second position. It is foreseen that the presence and effect of linkages of this type will vary between the various embodiments of this aspect of the present invention. Thus, depending on the design and the construction of any particular helmet at issue, at least some of the first plurality of floating pads may be movable between their second position and their first position independently of movement of others of the first plurality of floating pads from their second position to their first position, and some may not.

In some situations, this linkage may be preferred, and where this is the case, two of the first plurality of floating pads may be hingedly interconnected to achieve such effect. In some helmets of such construction, the hinged interconnection between the two of the first plurality of floating pads is itself movable with respect to the interior shell surface independently of movement of the two of the first plurality of floating pads relative to the interconnection.

Adjustable liners of the first aspect of the present invention are not limited to having solely floating pads; such liners may further comprise at least one fixed pad connected to the shell as well. As was the case with a floating pad, in the context of this aspect of the present invention, a fixed pad need not be a completely separate physical structure, although it may be. Thus, a fixed pad may comprise a material portion of a pad that is otherwise floating if that material portion is not free to materially move inward or outward with respect to the inner shell surface of the shell (although it may be capable of movement in some other direction). It is thus the case that a single physical structure may have a portion thereof being considered a fixed pad within the context of the present invention and may have another portion thereof being considered a floating pad within the context of the present invention.

Where present, it may be preferred that least some of the hinged connections supporting the first plurality of floating pads are directly to at least one fixed pad. This construction may provide for good anchoring of the floating pad within the adjustable liner. In other embodiments each of the first plurality of floating pads is supported through a hinged connection to at least one fixed pad. This construction may provide for even better anchoring of the floating pads within the adjustable liner. Finally, in still other embodiments, each of the first plurality of floating pads is attached to the shell solely via hinged connection to at least one fixed pad. This construction may provide for simplicity of liner manufacturing and may allow for a greater freedom of movement of the floating pad.

In a second aspect, as embodied and broadly described herein, the present invention provides a helmet comprising a rigid shell and adjustable liner connected to the shell. The shell has an interior shell surface defining a cavity within the shell for receiving a head of a wearer of the helmet. The shell also has a left side shell portion covering at least a majority of a left temporal portion of the head of the wearer when the helmet is being worn. The shell also has a right side shell portion covering at least a majority of a right temporal portion of the head of the wearer when the helmet is being worn. The shell also has a lower rear shell portion covering at least a majority of an occipital portion of the head of the wearer when the helmet is being worn. The adjustable liner has a plurality of pads, at least a first one of which is located in the cavity in juxtaposition with the left shell portion of the helmet, at least a second one of which is located in the cavity in juxtaposition with the right shell portion of the helmet and at least a third one of which is in juxtaposition with the lower rear shell portion of the helmet. At least each of the first and the second of the plurality of pads are movable with respect to the interior shell surface between a first position near the interior shell surface and a second position further away from the interior shell surface than the first position. The adjustable liner also has an encircling portion encircling a frontal portion, the left temporal portion, the right temporal portion and the occipital portion of the head of the wearer when the helmet is being worn. The encircling portion includes at least the first, the second, and the third of the plurality of pads and an elongated member operatively connected with at least the first and the second of the pads such that constriction of the encircling portion includes at least the first and the second of the pads moving from their respective first positions towards their respective second positions to assist in causing the liner to conform to the head of the wearer.

As was the case described hereinabove with respect to the first aspect, the present inventors have realized that at least part of the reason why there may have been difficulty with conventional helmets of this type in the prior art is that the liner adjustment mechanisms that such helmets used to conform to the head of the wearer were not designed so as to simply and adequately take into account the large variety of sizes and shapes of the heads of potential wearers and the individuality thereof with respect to any particular person. Thus, the comfort of such helmets could be improved, at least with respect to some individuals, if this were, at least partially, the case. Hence, helmets of this aspect of the present invention also have an improved design so as to allow for enhanced conformity to the particular shape of any given individual wearer's head, at least in a part of the left temporal and right temporal portions of the helmet. The action of constricting (of at least some of—as the case may be) the pads (in this aspect) as a group but allowing them each to adopt a position in which they are each individually disposed with respect to the head of the wearer to meet the size and shape of the wearer's head allows the liner to better conform to his head.

The left side shell portion is the portion of the shell of the helmet covering at least a majority of a left temporal portion of the head of the wearer when the helmet is being worn (by a wearer for whom the helmet is the correct size). The right side shell portion is the portion of the shell of the helmet covering at least a majority of a right temporal portion of the head of the wearer when the helmet is being worn (by a wearer for whom the helmet is the correct size). The lower rear shell portion is the portion covering at least a majority of an occipital portion of the head of the wearer when the helmet is being worn (by a wearer for whom the helmet is the correct size). It should be understood that (depending on the construction of any particular helmet at issue), that given the variety of different helmet constructions, in the context of this aspect of the present invention each of the left side shell portion, the right side shell portion, and the lower rear portion of the shell may comprise a single physical structure, a portion of a single physical structure, multiple physical structures, or portions of multiple physical structures. Further the construction of any one of these portions may be different from or the same as any other one of these portions (in this respect).

In the context of this aspect of the present invention, a pad need not be a completely separate physical structure, although it may be. Thus, a pad may comprise a material portion of a structure that is otherwise fixed if that material portion is free to move with respect to the inner shell surface between a first position near the interior shell surface and a second position further away from the interior shell surface than the first position.

Furthermore, in the context of this aspect of the present invention, a pad should be understood to be located in juxtaposition with a particular portion of the helmet (i.e. left temporal, right temporal, or occipital) if a material portion of the pad is so located (irrespective of whether the entire pad is so located). Juxtaposition with a particular portion (i.e. left temporal, right temporal, or occipital) does not, however, require a particular size and/or shape for any particular pad, nor for the plurality of pads. It should also be understood that this aspect of the present invention is not limited having pads in juxtaposition with the left temporal, right temporal, and occipital portions. Pads may be present in juxtaposition with other shell portions as well.

It should be understood that a first position near the interior shell surface includes first positions wherein the pad abuts the interior shell surface.

It should also be understood that in the context of this aspect of the invention, it is not required that the encircling portion of the liner have any particular shape or construction. In different embodiments the encircling portion will thus have different shapes and constructions. Nor is it required that the encircling portion be continuous. Encircling portions having discontinuities are with the scope of this aspect of the present invention. Thus encircling portions do not need to completely encircle the head of a wearer, they need only materially encircle the head of a wearer.

In some embodiments the elongated member will completely encircle the head of the wearer when the helmet is being worn, for greater effectiveness in assisting in causing the liner to conform to the head of the wearer. However, as was noted above encircling portions with the scope of this aspect of the invention need not completely encircle the head of a wearer and in thus embodiments where they do not, the elongated member will not completely encircle the head of the wearer. Thus, as an example, in one embodiment, the elongated member may comprise a first portion attached to the interior shell surface of the upper shell portion at a first point and at a second portion discontinuous from the first portion attached to the interior shell surface of the upper shell portion at a second point spaced apart from the first point. Similarly, the encircling portion may further comprise an adjustor operatively connected to each of the portions of the elongated member, the adjustor itself forming a portion of the encircling portion.

For simplicity of design, it is highly preferred (although not required) that constriction of the elongated member cause constriction of the encircling portion. Further, for greater effectiveness in assisting in causing the liner to conform to the head of the wearer, it is preferred (although not required) that the elongated member be further operatively connected with the third pad and that constriction of the encircling portion further include the third pad moving from a third position to a fourth position (the fourth position being closer to the head of the wearer than the third position).

Again for simplicity of design, it is preferred that the elongated member is attached to at least the first and the second floating pads. Optionally, it may be attached to the third. Such attachment to any floating pad is not, however, required. As an example, in some embodiments, the elongated member may pass through a hole in the floating pad or through or around a structure secured to the floating pad, without actually being attached to the floating pad. No particular construction is required. It is sufficient for an elongated member in operation to cause movement of the floating pads to be within the scope of this aspect of the present invention.

For similar reasons, and to provide for additional structural support to the liner and for securing the liner to the shell, it is preferred that the elongated member be attached to the interior shell surface.

For ease of operation, it is preferred that an adjustor having one of a dial, a bar, and a clamp be operatively connected to the elongated member for causing constriction of the elongated member. No particular adjustor construction is required and thus the adjustor may or may not comprise part of the encircling portion itself. For simplicity, it is preferred that the adjustor be connected to at least the third pad.

While in various embodiments of this aspect of the invention any number of structures that fulfil the functions thereof described herein may be an elongated member (e.g., a strap, a wire, an elongated piece of material), a strap is preferred.

Thus in summary, in various embodiments, this second aspect of the present invention provides:

(i) A helmet as described, wherein constriction of the elongated member causes constriction of the encircling portion.

(ii) A helmet as described, wherein the elongated member completely encircles the head of the wearer when the helmet is being worn.

(iii) A helmet as described, wherein the elongated member is attached to at least the first and the second floating pads.

(iv) A helmet as described, wherein the elongated member is attached to the interior shell surface.

(v) A helmet as described, further comprising an adjustor having one of a dial, a bar, and a clamp operatively connected to the elongated member for causing constriction of the elongated member.

(vi) A helmet as described, wherein the elongated member is further operatively connected with the third pad and constriction of the encircling portion further includes the third pad moving from a third position to a fourth position to assist in causing the liner to conform to the head of the wearer.

(vii) A helmet as described, wherein the adjustor is connected to at least the third pad.

(viii) A helmet as described, wherein the elongated member is further operatively connected with the third pad and constriction of the encircling portion further includes the third pad moving from a third position to a fourth position to assist in causing the liner to conform to the head of the wearer.

(ix) A helmet as described, wherein the elongated member is attached to the interior shell surface.

(x) A helmet as described, wherein the elongated member is a strap.

(xi) A helmet as described, wherein the elongated member comprises a first portion attached to the interior shell surface of the upper shell portion at a first point and at a second portion discontinuous from the first portion attached to the interior shell surface of the upper shell portion a second point spaced apart from the first point.

(xii) A helmet as described, wherein the encircling portion further comprises an adjustor having one of a dial, a bar, and a clamp operatively connected to each of the portions of the elongated member, the adjustor for causing constriction of the elongated member.

(xiii) A helmet as described, wherein the elongated member is attached to at least the first and the second floating pads.

(xiv) A helmet as described, wherein the elongated member is attached to the interior shell surface.

Finally, in a third aspect, as embodied and broadly described herein, the present invention provides a helmet combining both features of the previously described first and second aspects of the invention.

Thus, in this third aspect, the present invention provides a helmet having a rigid shell and an adjustable liner connected to the shell. The shell has an interior shell surface defining a cavity within the shell for receiving a head of a wearer of the helmet. The shell also has an upper shell portion covering at least a majority of a frontal portion and parietal portions of the head of the wearer when the helmet is being worn. The shell also has a left side shell portion covering at least a majority of a left temporal portion of the head of the wearer when the helmet is being worn. The shell also has a right side shell portion covering at least a majority of a right temporal portion of the head of the wearer when the helmet is being worn. The shell also has a lower rear shell portion covering at least a majority of an occipital portion of the head of the wearer when the helmet is being worn.

The adjustable liner includes a first plurality of floating pads located in the cavity in juxtaposition with the upper shell portion of the helmet. Each of the first plurality of floating pads is movable with respect to the interior shell surface between a first position near the interior shell surface and a second position further away from the interior shell surface than the first position. Each of the first plurality of floating pads is biased towards its second position with an amount of force that can be overcome by the wearer inserting his head into the helmet. The act of the wearer inserting his head into the helmet causes each of the first plurality of floating pads to move from its second position towards its first position while remaining biased against the head of the wearer to assist the liner in conforming to the head of the wearer while supporting the helmet on the head of the wearer.

The adjustable liner further includes a second plurality of pads. The second plurality of pads includes a left temporal floating pad located in the cavity in juxtaposition with the left shell portion of the helmet, a right temporal floating pad located in the cavity in juxtaposition with the right shell portion of the helmet, and an occipital pad in juxtaposition with the lower rear shell portion of the helmet. At least the left temporal floating pad and the right temporal floating pad are movable with respect to the interior shell surface between a first position near to the interior shell surface and a second position further away from the interior shell surface than the first position.

The adjustable liner further includes an encircling portion encircling the frontal portion, the left temporal portion, the right temporal portion and the occipital portion of the head of the wearer when the helmet is being worn. The encircling portion includes at least the left temporal floating pad, the right temporal floating pad, the occipital pad and an elongated member operatively connected with at least the left temporal floating pad and the right temporal floating pad such that constriction of the encircling portion includes at least the left temporal floating pad and the right temporal floating pad moving from their respective first positions towards their respective second positions to assist in causing the liner to conform to the head of the wearer.

Additional description, features, alternatives, and possibilities in relation to this third aspect of the present invention are similar to those described above in respect of the first and second aspects of the invention (as the case may be), only some of which are briefly summarized below for avoidance of redundancy. Thus, with respect to this third aspect of the present invention, in various embodiments: (i) Constriction of the elongated member causes constriction of the encircling portion. (ii) The elongated member completely encircles the head of the wearer when the helmet is being worn. (iii) The elongated member is attached to at least the first and the second floating pads. (iv) The elongated member is attached to the interior shell surface. (iv) The helmet further comprises an adjustor having one of a dial, a bar, and a clamp operatively connected to the elongated member for causing constriction of the elongated member. (v) The elongated member is further operatively connected with the third pad and constriction of the encircling portion further includes the third pad moving from a third position to a fourth position to assist in causing the liner to conform to the head of the wearer. (vi) The adjustor is connected to at least the third pad. (vii) The elongated member is a strap. (viii) The elongated member comprises a first portion attached to the interior shell surface at a first point and at a second portion from the first portion attached to the interior shell surface a second point spaced apart from the first point; and the encircling portion further comprises an adjustor having one of a dial, a bar, and a clamp operatively connected to each of the portions of the elongated member, the adjustor for causing constriction of the elongated member, the encircling portion being discontinuous.

Additional description, features, alternatives, and possibilities in relation to this third aspect of the present invention are as described above in respect of the first and second aspects of the invention (as the case may be) and will not be repeated here for avoidance of redundancy.

Finally, it should be understood that embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF A PREFERRED EMBODIMENT

Introduction

Figure 1:
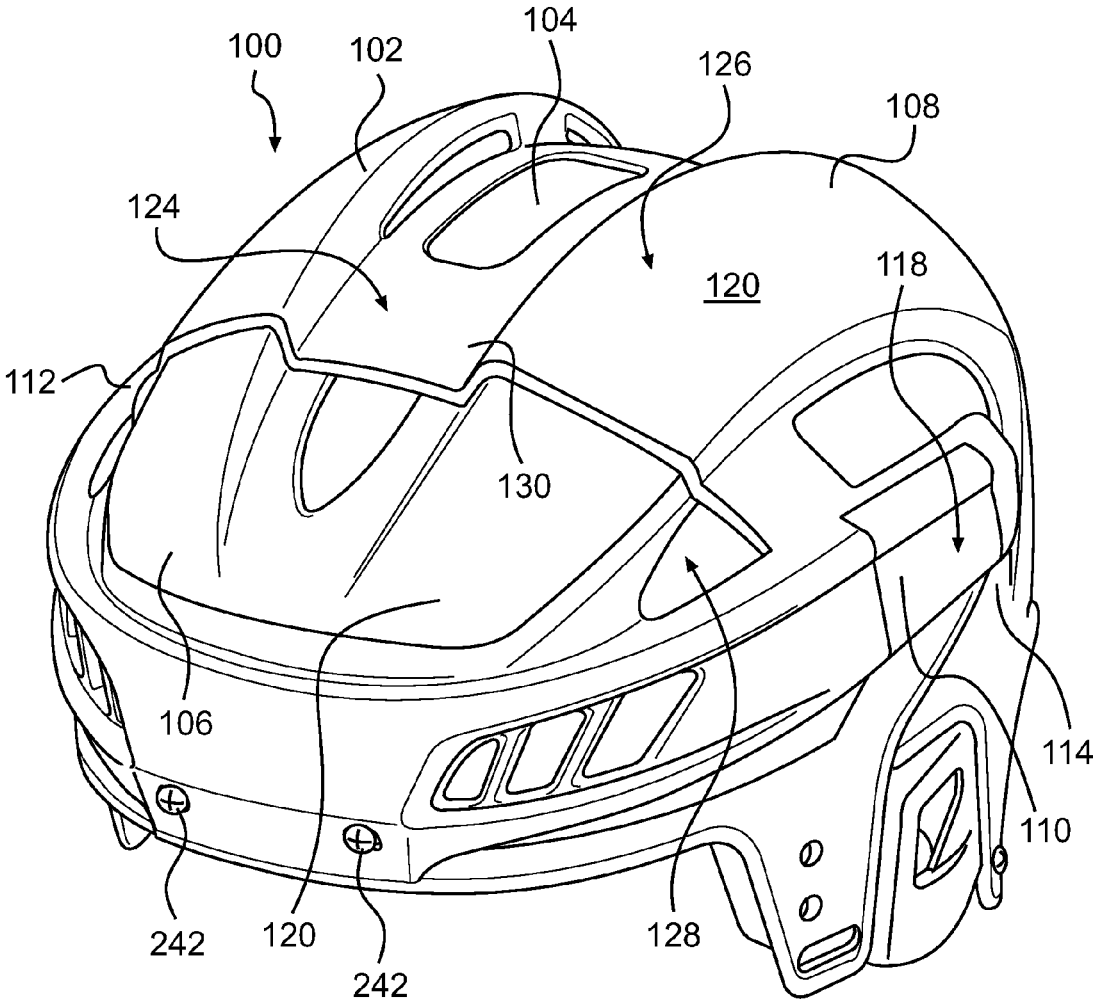
FIG. 1 is a front left perspective view of an ice hockey helmet having a rigid shell and an adjustable liner being an embodiment of the present invention.

In the Figures, there is shown an ice hockey helmet 100 being a preferred embodiment of each of the three aforementioned aspects of the present invention. The description thereof that follows is intended to be only a description of a physical example of the invention. This description is not intended to define the scope of nor set forth the bounds of the invention. In some cases, what are believed to be helpful examples of modifications to the ice hockey helmet 100 that might occur in other embodiments are also set forth hereinbelow. This is done merely as an aid to understanding, and, again, not to define the scope of nor set forth the bounds of the invention. Where present, these modifications are only for ease of understanding and are not intended to provide an exhaustive list of any kind. Further, where this has not been done, i.e. where no examples of modifications have been set forth, it should not be interpreted that no modifications are possible and/or that what is described is the sole physical means of embodying that element of the invention. As would be understood by one skilled in the art, this is likely not the case.

Ice hockey helmet 100 has a shell 102 and an adjustable liner 104. The liner 104 is connected to the shell 102, such that the liner 104 does not fall out of the shell 102 or become displaced when the helmet 100 is not being worn. (The connection and the relationship between the shell 102 and the liner 104 will be described in more detail below).

Description of the Shell

The shell 102 is a two-part shell composed of a front shell part 106 and a rear shell part 108. The front shell part 106 and the rear shell part 108 are slidably engaged with each other and are adjustably attached to each other at the left side 110, 114 (respectively) and the right side 112, 116 (respectively) thereof. The front shell part 106 and rear shell part 108 may be adjusted with respect to one another via a shell adjustment mechanism 118. The adjustment of the front and rear shell parts 106 and 108 provides for a proper adjustment of the helmet 100 to a particular size of the head of the wearer.

Figure 5:
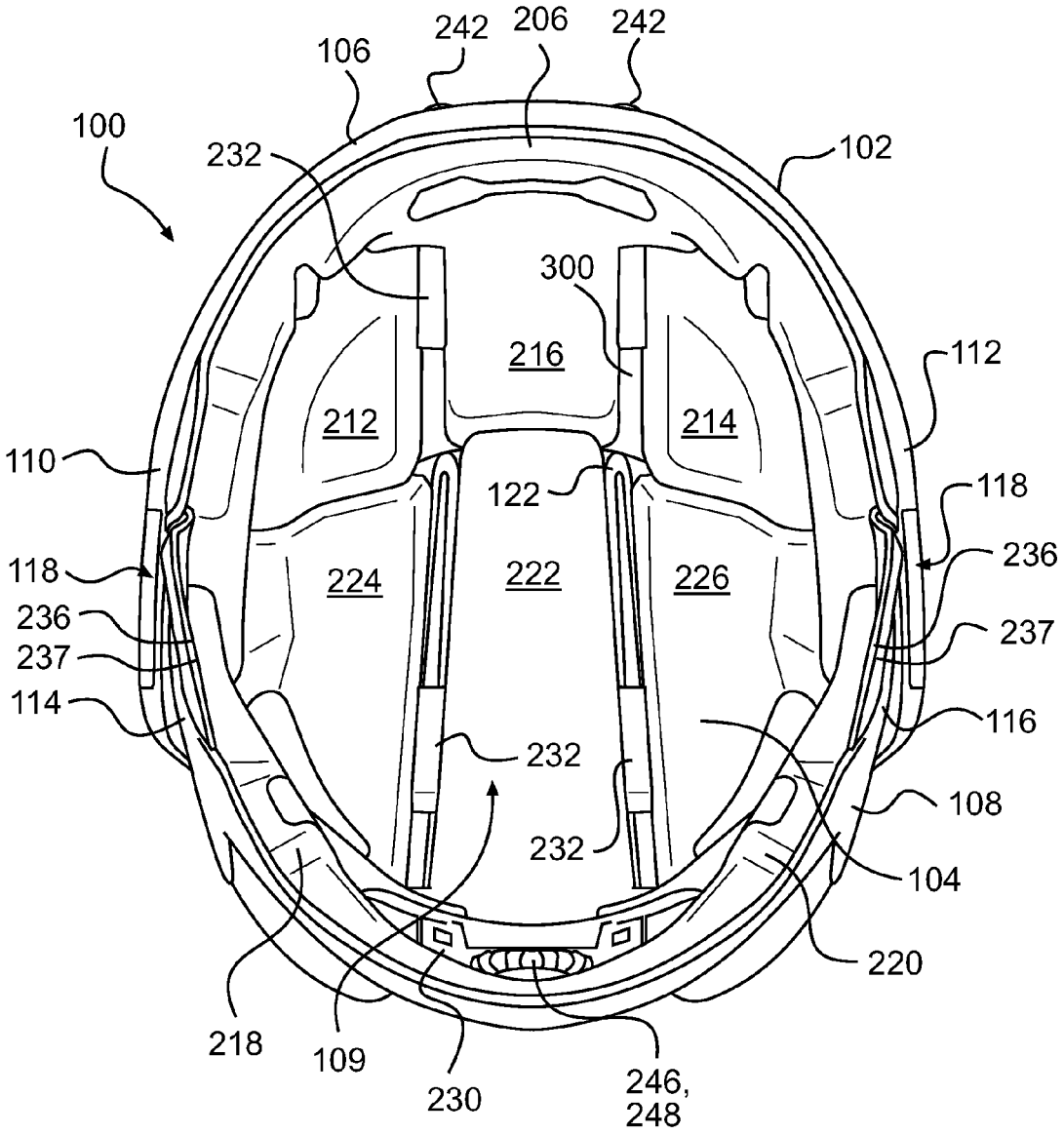
FIG. 5 is a bottom plan view of the ice hockey helmet of FIG. 1.
Figure 11:
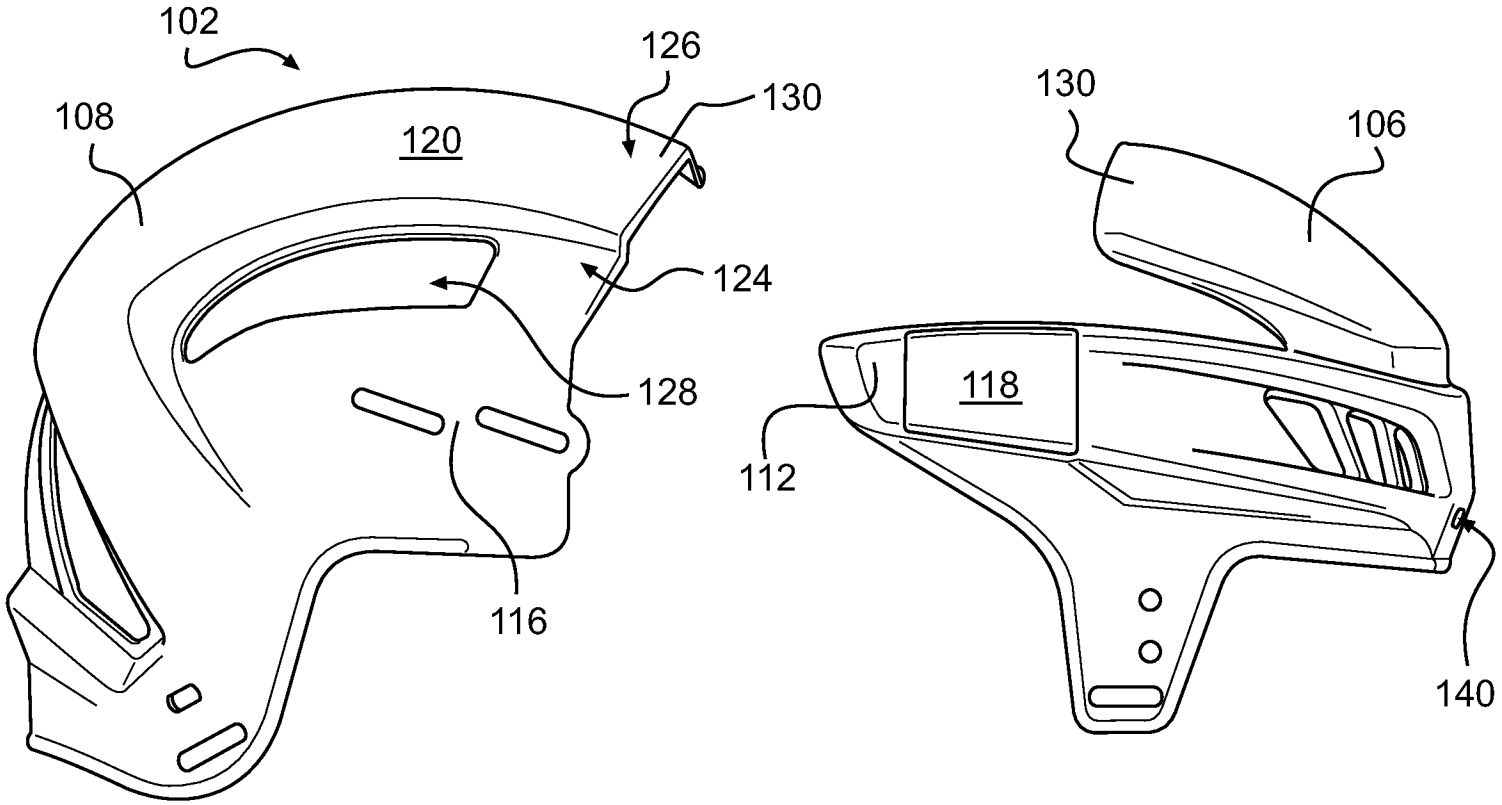
FIG. 11 is a right side elevation view of the shell of FIG. 10, separated into its two constituent parts.

The adjustment mechanism 118 permits adjustment of the front and rear shell parts 106 and 108 (respectively) by sliding one with respect to the other to provide for the reduction or the enlargement (as the case may be) of the cavity 109 (shown in FIG. 5) that receives the head of the wearer based on the size of the wearer's head. Also, the adjustment mechanism 118 permits disengagement and detachment of the front and rear shell parts 106 and 108 (respectively) from each other as shown in FIG. 11. The shell adjustment mechanism 118 is conventional will not be otherwise be described in detail. In other embodiments of the invention, other suitable shell adjustment mechanisms known in the art may be used. (Examples of such adjustment mechanisms may be found in United States Patent Application Publication Nos. 2007/0079429 and 2007/0266482 and U.S. Pat. Nos. 7,634,820 and 6,108,824, all of which are incorporated herein by reference.) Further, it is contemplated that in other embodiments the shell 102 may be composed of several shell parts (i.e. more than two) that can be adjusted with respect to one another, that the shell 102 may be composed of shell parts that may be non-adjustably affixed to another, or that the shell 102 may be of a unitary construction.

Referring to any of the FIGS. 1, 3, 4, and 9, the shell 102 has a exterior shell surface 120 that will receive the impact of a hit, blow etc. received by the head of the wearer wearing the helmet. The shell 102 also has an interior shell surface 122 (described in greater detail herein below).

Figure 6:
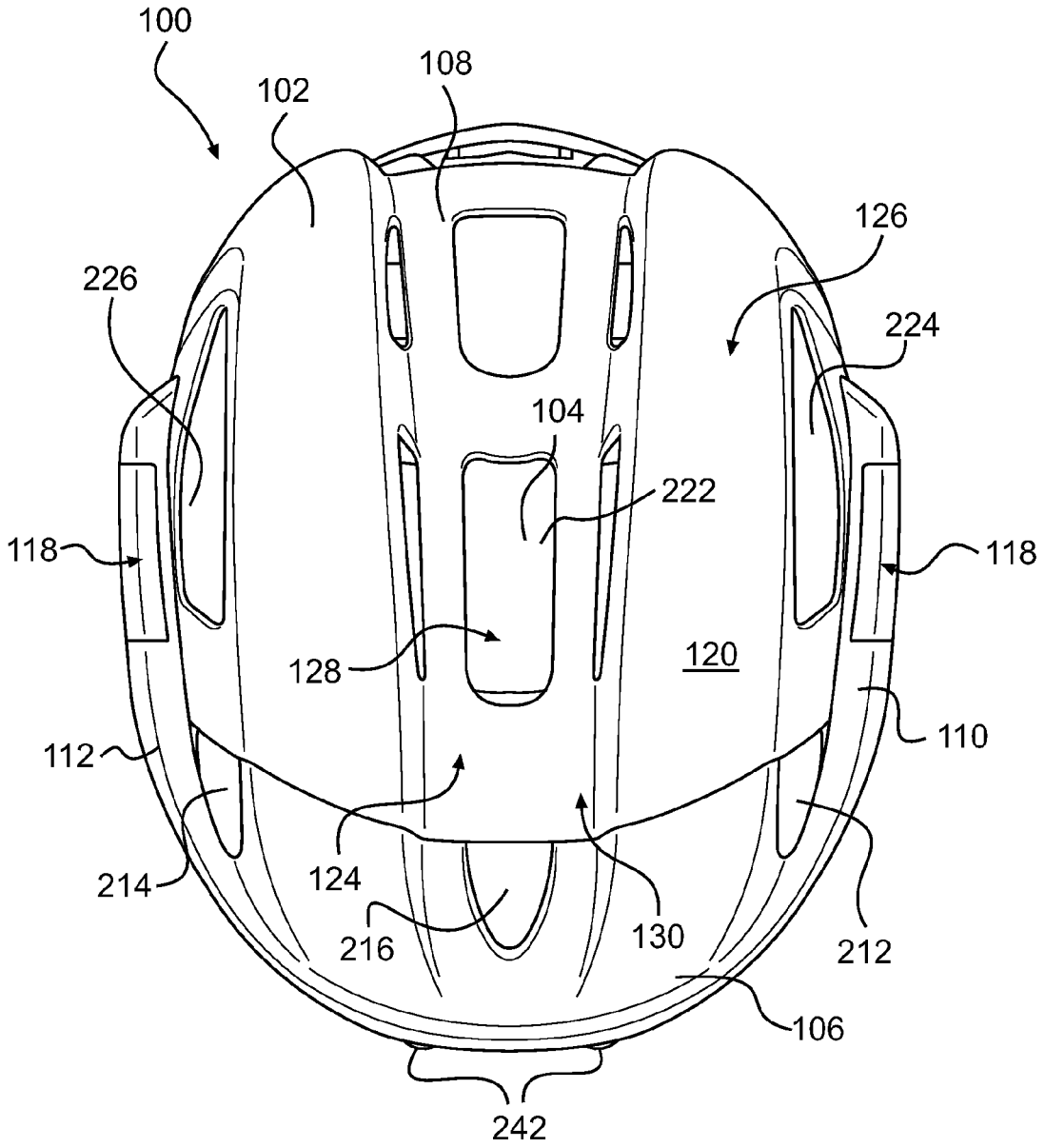
FIG. 6 is a top plan view of the ice hockey helmet of FIG. 1.
Figure 7:
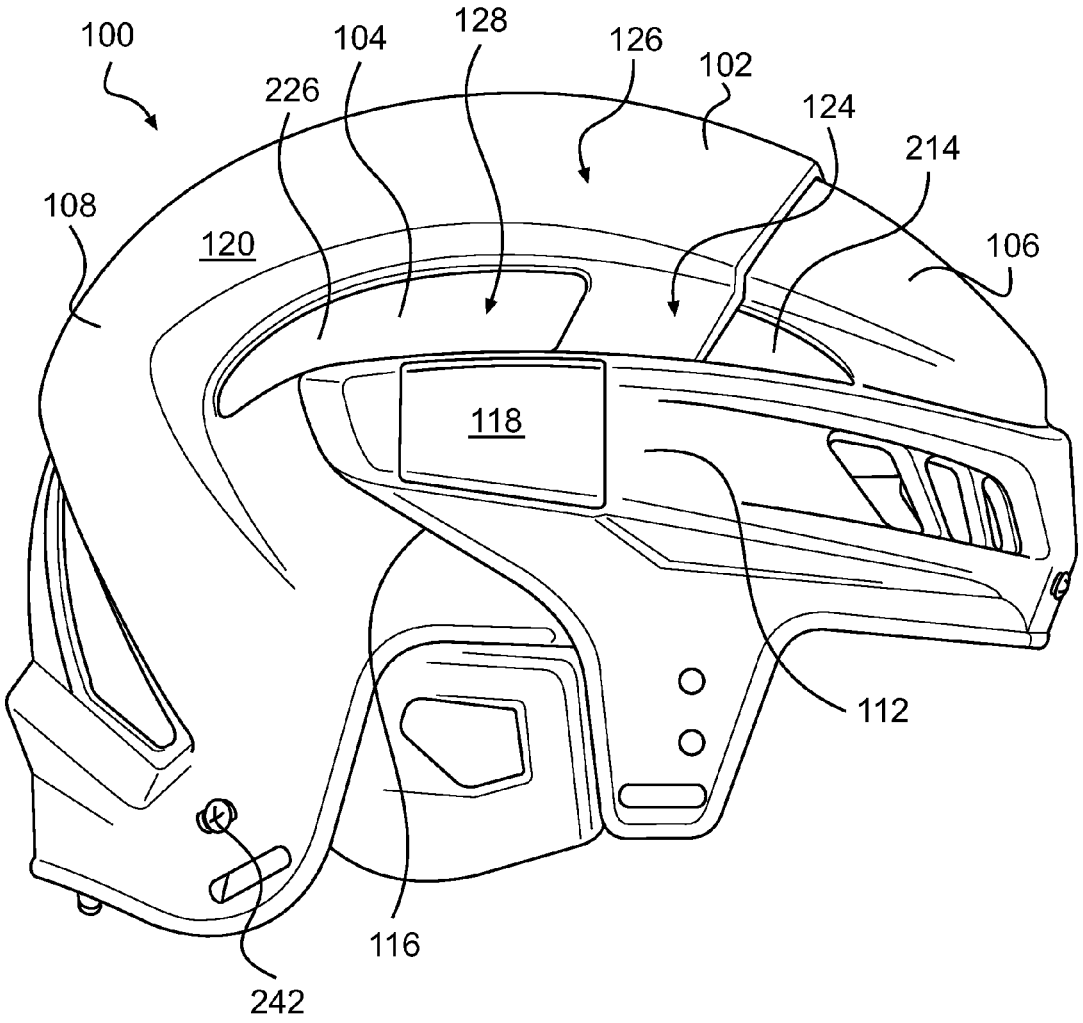
FIG. 7 is a right side elevation view of the ice hockey helmet of FIG. 1, a left side elevation view being a mirror image thereof.

Referring to FIGS. 1, 6, and 7, the exterior shell surface 120 has indentations 124, protrusions 126, and apertures 128 therein. Correspondingly, the interior shell surface 122 (FIG. 9) has corresponding protrusions 124*a*, indentations 126*a* and apertures 128 there that correspond to those of the exterior shell surface 120, such that the indentation 124 of the exterior shell surface 120 corresponds to a respective protrusion 124*a* of the interior shell surface 122, the protrusions 126 extending out of the exterior shell surface 120 corresponds to the respective indentations 126*a* of the interior shell surface 122, and the aperture 128 in the exterior shell surface 120 corresponds to the respective aperture 128 in the interior shell surface 122.

The indentations and protrusions in the shell surfaces can assist in providing a more impact-resistant shell structure as compared to a shell having no protrusions and indentations therein. Further, the indentations and protrusions of the interior shell surface of rear shell part 108 are disposed so as to mate with corresponding protrusions and indentations of the exterior shell surface of front shell part 106 during the sliding engagement of the shell 102.

The apertures 128 in the shell 102 serve to provide ventilation for the head of the wearer when the helmet is being worn. It is contemplated that the apertures 128 may have a different design or may be omitted altogether in other embodiments.

Figure 2:
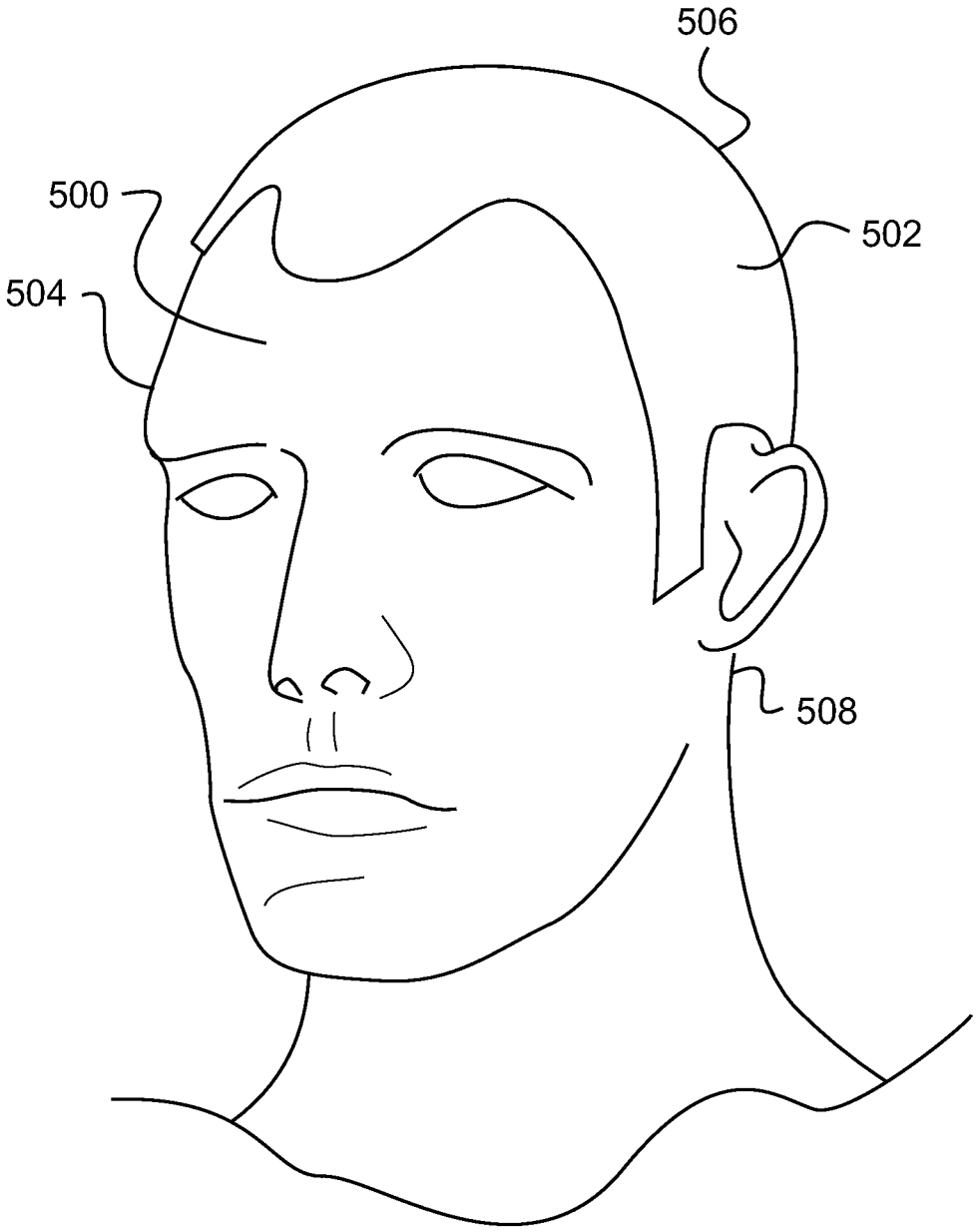
FIG. 2 is a front left perspective view of a head of a potential wearer of the ice hockey helmet of FIG. 1.
Figure 3:
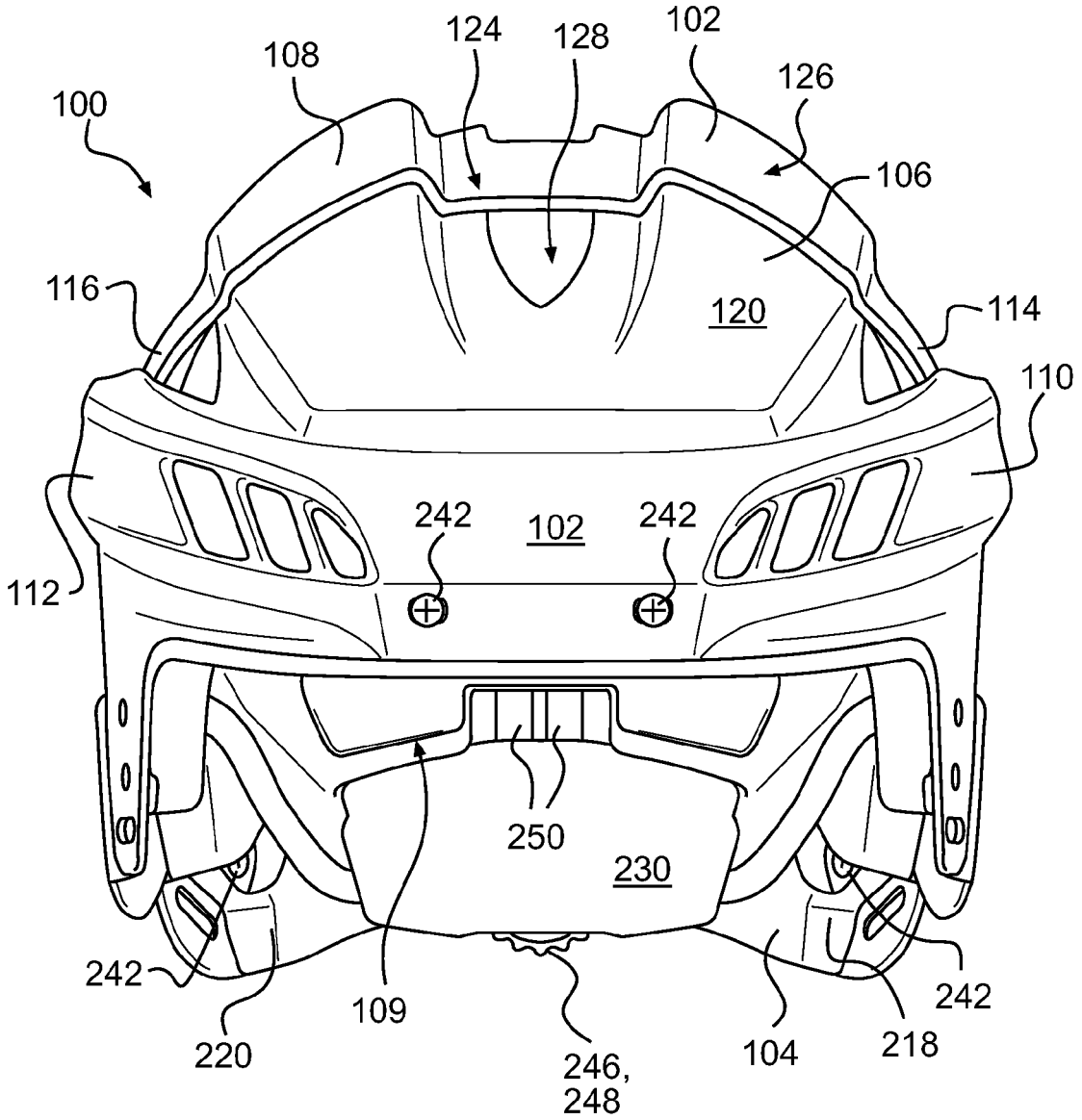
FIG. 3 is a front elevation view of the ice hockey helmet of FIG. 1.
Figure 9:
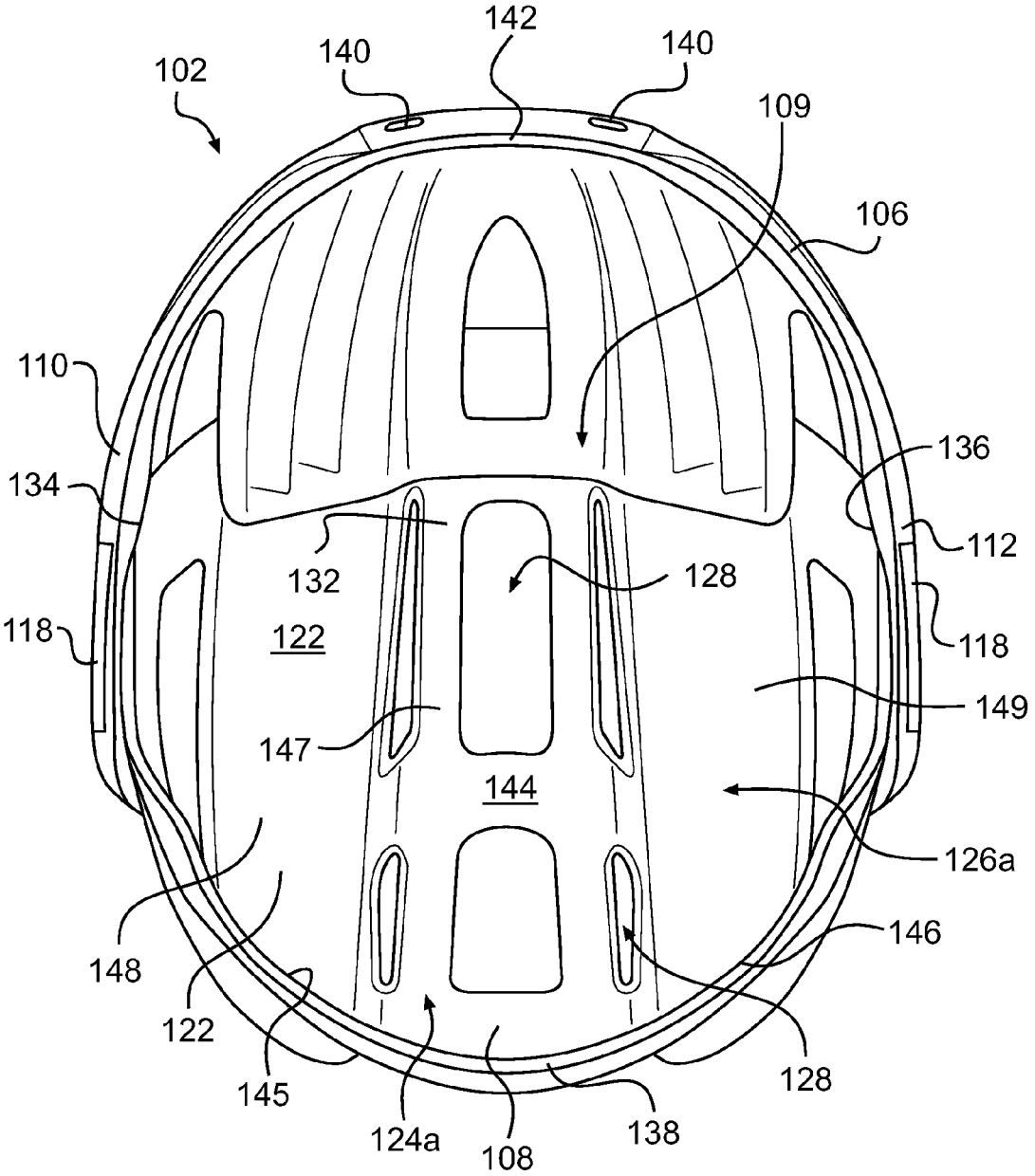
FIG. 9 is a bottom plan view of the shell of the ice hockey helmet of FIG. 1.
Figure 10:
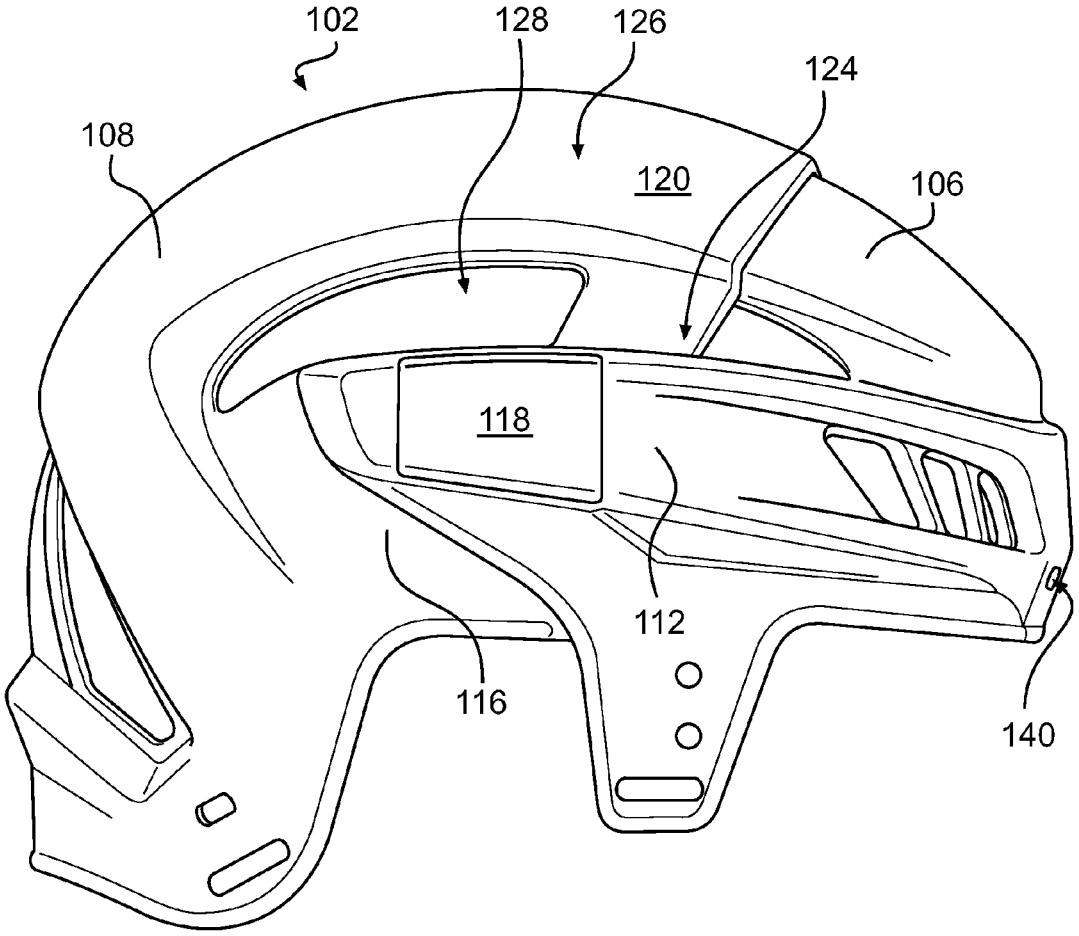
FIG. 10 is a right side elevation view of the shell of FIG. 8, a left side elevation view being a mirror image thereof.

Referring to FIG. 9, the interior shell surface 122 of the shell 102 defines the cavity 109 for receiving the head of the wearer. Now referring to both FIGS. 2 and 9, the interior shell surface 122 defines a frontal inner shell portion 142, which covers a majority of the frontal portion 500 of the head of the wearer. The interior shell surface 122 further defines an upper shell portion 132, which covers a majority of the frontal portion 500 and of the parietal portion 506 of the head of the wearer when the helmet 100 is being worn. The interior shell surface 122 further defines a parietal shell portion 144 which covers a majority of the parietal portion 506 of the head of the wearer. The interior shell surface 122 further defines a left side shell portion 134 which covers the majority of the left temporal portion 502 of the head of the wearer when the helmet 100 is being worn. The interior shell surface 122 also defines a right side shell portion 136 which covers the right temporal portion 504 of the head of the wearer when the helmet 100 is being worn. The interior shell surface 122 defines the lower rear shell portion 138 which covers the majority of the occipital portion 508 of the head of the wearer when the helmet 100 is being worn.

Description of the Shell—Manufacture

The shell 102 is moulded through conventional means familiar to those skilled in the art of ice hockey helmets, such as, for example, injection or compression molding. In some embodiments the shell 102 comprises a plastic or composite material such as, for example, high density polyethylene (HDPE), acrylonitrile butadiene styrene (ABS), polyurethane (PU), nylon, polycarbonate (PC), polypropylene (PP), a reinforcing material (e.g., glass, carbon, or aramid fiber) and combinations thereof.

Description of the Liner—Parts

Figure 12:
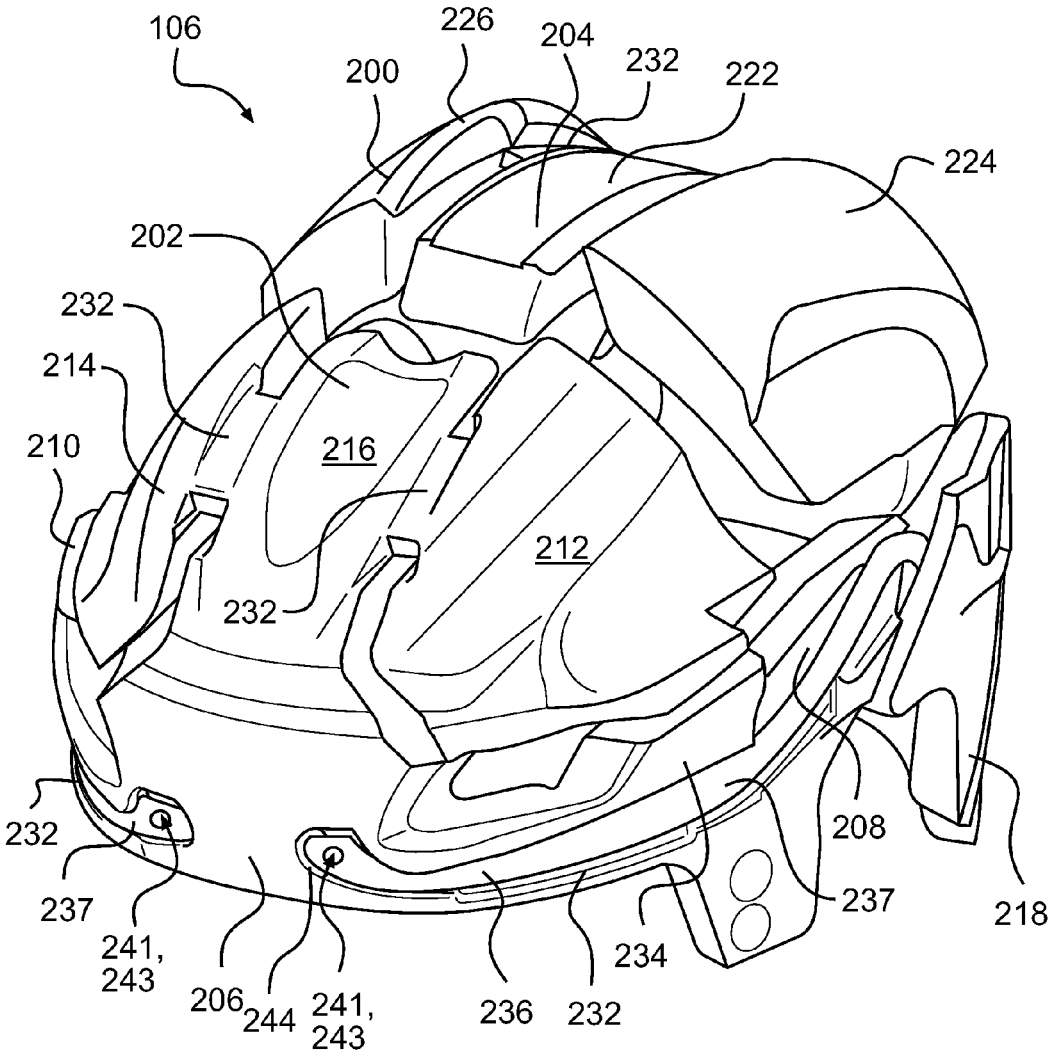
FIG. 12 is a front left perspective view of the adjustable liner of the ice hockey helmet of FIG. 1, separated into its two constituent parts.

Referring to FIG. 12, the liner 106 has a plurality of pads 200. The plurality of pads 200 includes a front plurality of pads 202 and a rear plurality of pads 204. The front plurality of pads 202 contacts the majority of the frontal 500, the left temporal 502 and the right temporal 504 portions of the head (e.g. FIG. 2) of the wearer when the helmet 100 is being worn. The rear plurality of pads 204 contacts the majority of the parietal 506 and the occipital 508 portions of the head of the wearer when the helmet 100 is being worn.

Referring to FIGS. 12, 14, 17 and 18, the front plurality of pads 202 consists of fixed pad 206 and floating pads (being the left temporal pad 208, the right temporal pad 210, and pads 212, 214, and 216). Fixed pad 206 is disposed in juxtaposition with a portion of a frontal inner shell portion 142 (and thus the upper shell portion 132) and covers a portion of the frontal portion 500 of the head of the wearer when the helmet 100 is being worn. (In other embodiments, fixed pad 206 and floating pad 216 form a single pad covering a portion of the frontal portion 500 and at least a portion of the parietal portion 506 of the head of the wearer of the head of the wearer when the helmet 100 is being worn.) The left temporal pad 208 is disposed in juxtaposition with a majority of the left side shell portion 134 and covers the majority of the left temporal portion of the head of the wearer when the helmet 100 is being worn. The right temporal pad 210 is disposed in juxtaposition with a majority of the right side shell portion 136 and covers the majority of the right temporal portion of the head of the wearer when the helmet 100 is being worn. The floating pads 212, 214, and 216 are disposed in juxtaposition with a portion of the upper shell portion 132 of the front shell portion 106 and cover the majority of the remaining portions of the frontal, the left temporal and the right temporal portions as well as portions of the parietal portion of the head of the wearer when the helmet 100 is being worn. In this embodiment, there is no actual hinged connection between fixed pad 206 and floating pad 216; the pads 206 and 216 are made of a single piece of foam that flexes forming a live hinge between the pads.

Figure 13:
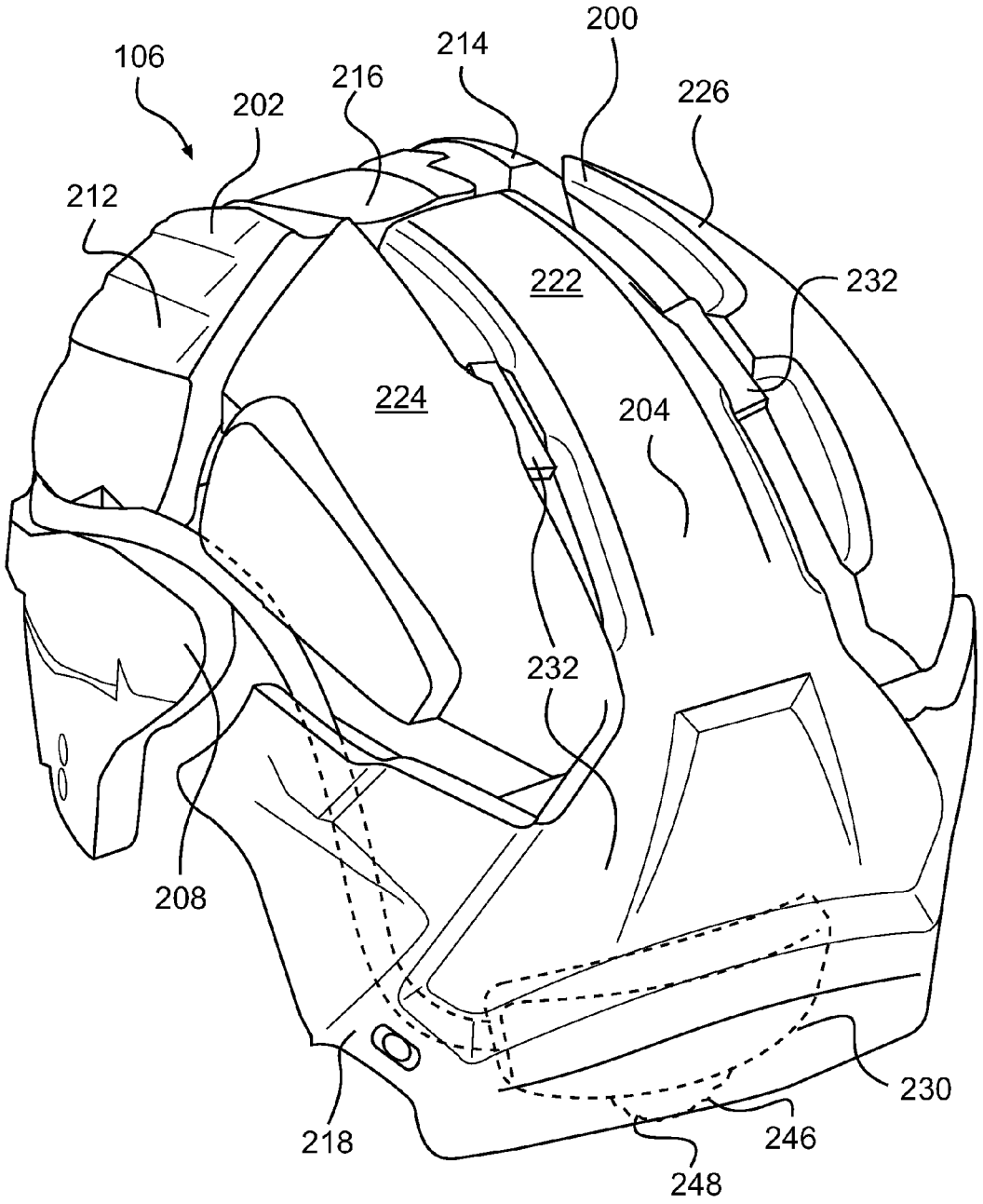
FIG. 13 is a rear left perspective view of the liner of FIG. 12.
Figure 14:
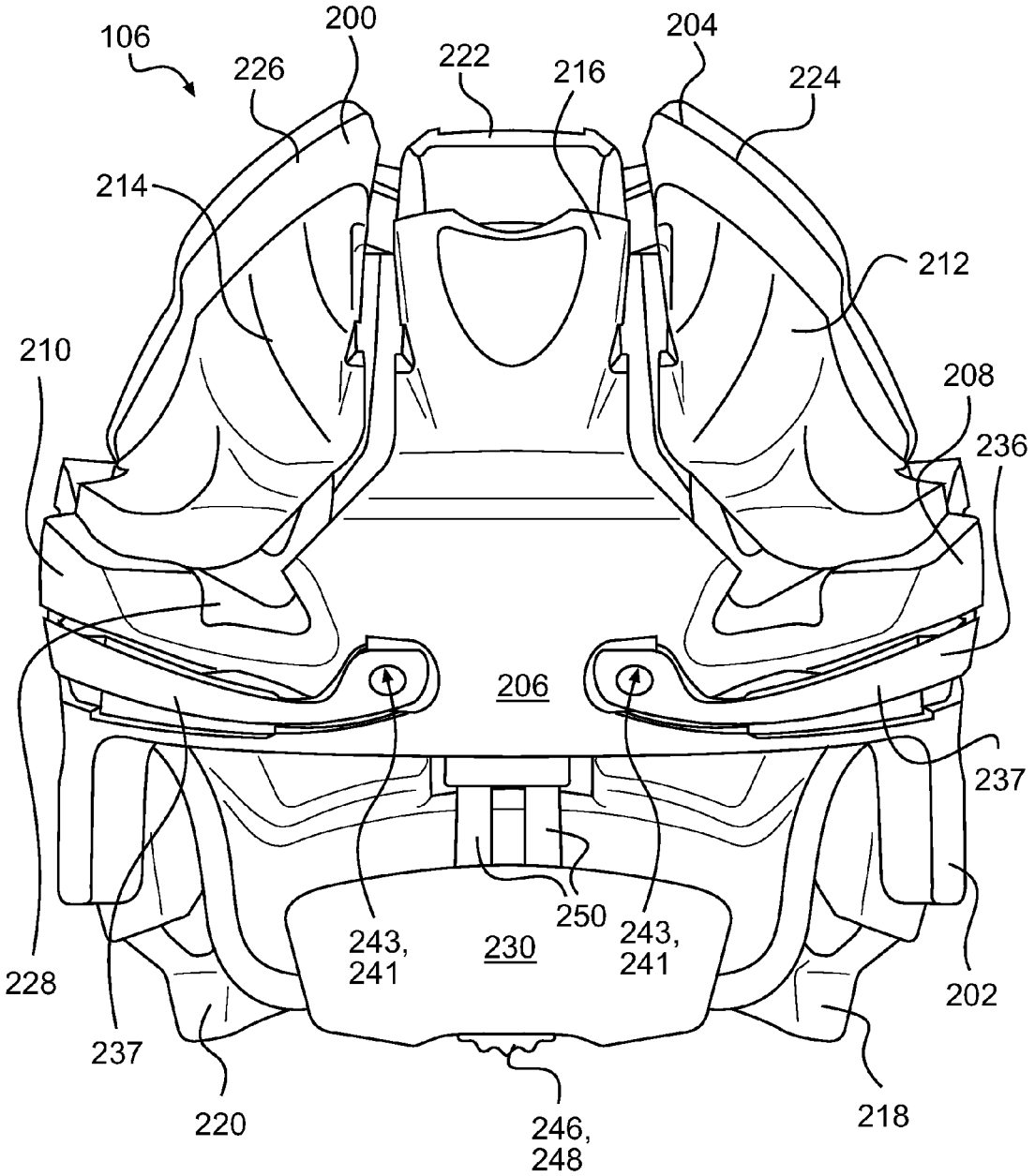
FIG. 14 is a front elevation view of the liner of FIG. 12.
Figure 15:
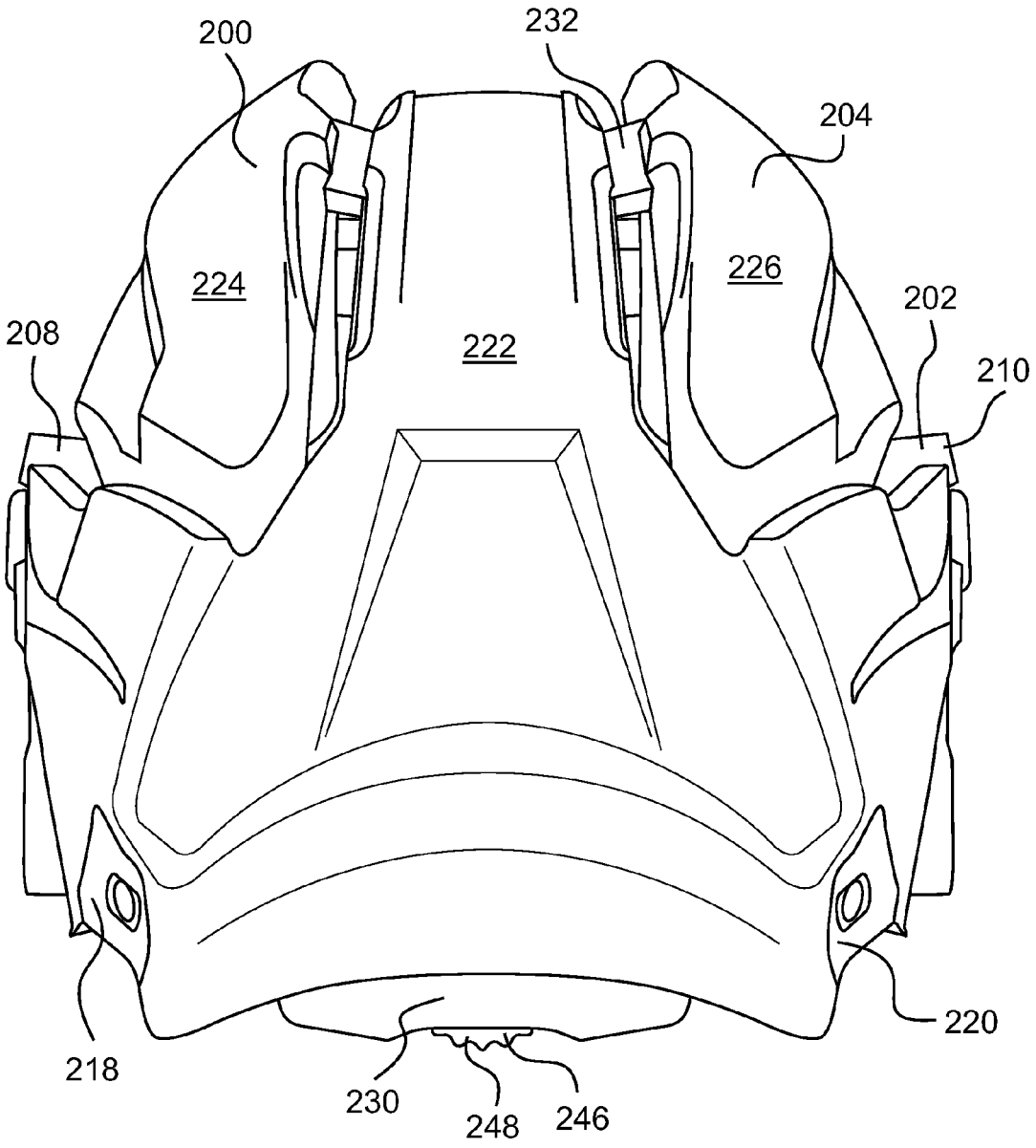
FIG. 15 is a rear elevation view of the liner of FIG. 12.
Figure 16:
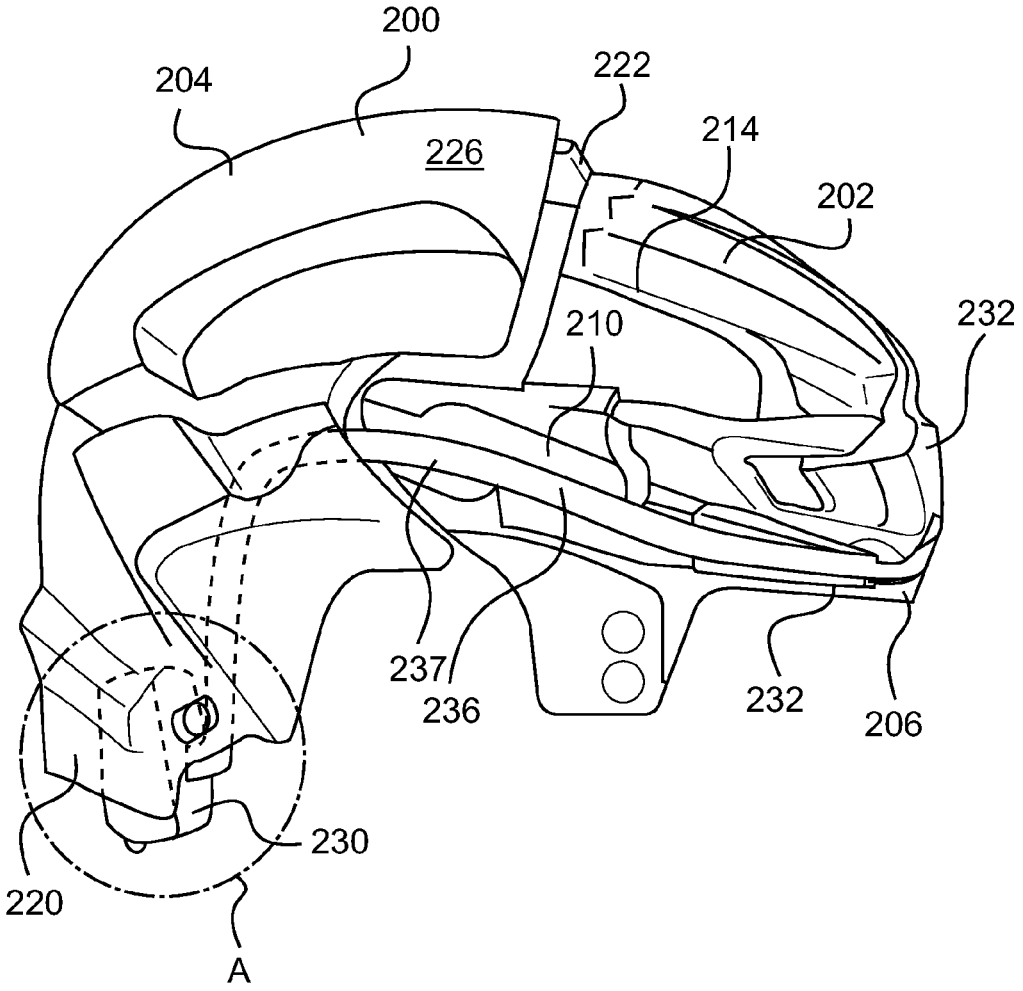
FIG. 16 is a right side elevation view of the liner of FIG. 12, a left side elevation view being a mirror image thereof.
Figure 17:
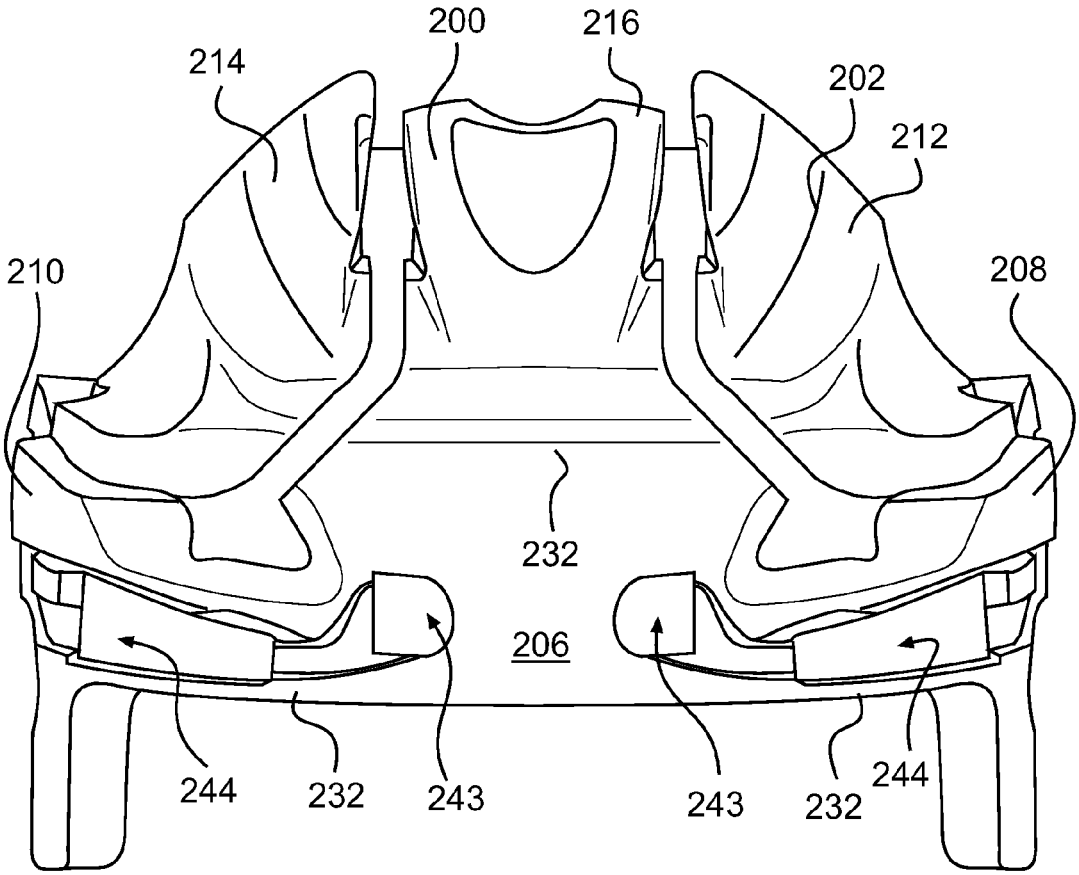
FIG. 17 is a front elevation view of the front liner part of the liner of FIG. 12.
Figure 18:
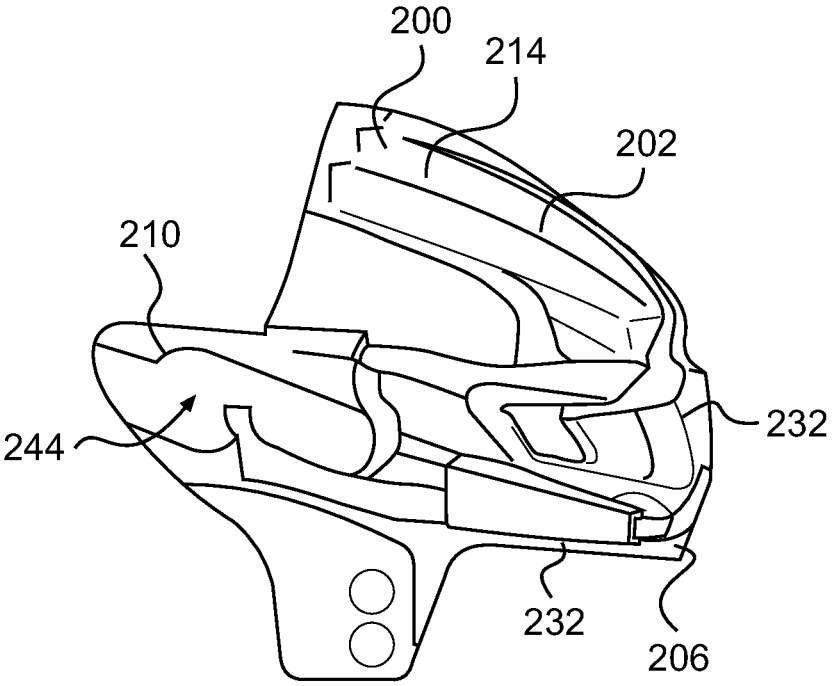
FIG. 18 is a right side elevation view of the front liner part of FIG. 17, a left side elevation view being a mirror image thereof.

Referring to FIGS. 13, 15 and 16, the rear plurality of pads 204 consists of fixed pads 218 and 220, and floating pads 222, 224, and 226, and occipital pad 230. Fixed pad 218 is disposed in juxtaposition with a portion of a lower left parietal shell portion 145 of the parietal shell portion 144 (and thus the upper shell portion 132) and covers a portion of the lower left parietal portion of the head of the wearer when the helmet 100 is being worn. Fixed pad 220 is disposed in juxtaposition with a portion of a lower right parietal shell portion 146 of the parietal shell portion 144 (and thus the upper shell portion 132) and covers a portion of the lower right parietal portion of the head of the wearer when the helmet 100 is being worn. Floating pad 222 is disposed in juxtaposition with a portion of a upper shell portion 132 and covers the majority of the rear central parietal portion of the head of the wearer when the helmet 100 is being worn. Floating pad 224 is disposed in juxtaposition with a portion of a left parietal shell portion 148 of the parietal shell portion 144 (and thus the upper shell portion 132) and covers the majority of the top left parietal portion of the head of the wearer when the helmet 100 is being worn. Floating pad 226 is disposed in juxtaposition with a portion of a right parietal shell portion 149 of the parietal shell portion 144 (and thus the upper shell portion 132) and covers the majority of the top right parietal portion of the head of the wearer when the helmet is being worn. Occipital pad 230 is disposed in juxtaposition with a rear lower shell portion 138 and covers the majority of the occipital region of the head of the wearer when the helmet 100 is being worn.

It is contemplated that in other embodiments the plurality of pads 200 may have a smaller or a greater number of individual pads. Such pads may be arranged similarly or differently from those of the present embodiment. It is contemplated that in other embodiments the plurality of pads 200 may cover more or less of the portions of the head of the wearer when the helmet 100 is being worn.

The relationship of various pads of the plurality of pads 200 to various shell portions of the shell 102, as well as the difference between fixed pads 206, 220, and 222 and floating pads 208 to 230 will be described in more detail below.

Several of the plurality of pads 200 have at least one hinged connection 232 which connects each of the plurality of pads 200 to at least one other pad of the plurality of pads 200. Specifically, in one embodiment, fixed pad 206 has two hinged connections 232. Each of the two hinged connections 232 connects the fixed pad 206 to floating pads (to the left temporal pad 208 and to the right temporal pad 210). Floating pad 216 is connected via two hinged connections 232 to floating pads 212 and 214, thus floating pads 212 and 214 are interconnected to one another via their connection with floating pad 216.

Fixed pads 218 and 220 are connected to floating pad 222. Floating pad 222 is hingedly connected to floating pads 224, 226 (interconnecting those pads 224, 226 with each other) and to the occipital pad 230 (which in this embodiment is also floating).

Each of the floating pads is movable with respect to the inner shell surface 122 between a plurality of positions (as will be described in more detail below) as a result, for example, of their respective hinged connections 232. Some pads of the plurality of pads 200 are movable independently from one another, particularly, the pads of the front plurality of pads 202 are independently movable from the pads of the rear plurality of pads 206. Also, floating pads 208, 210, 212, 214 and 216 of the front plurality of pads 202 may be movable independently from each other (in some cases depending on the size and shape of the head of the wearer). Similarly, floating pads 222, 224, 226, and 230 of the rear plurality of pads 204 may be movable independently from each other (again, in some cases depending on the size and shape of the head of the wearer).

Each of the floating pads of the front plurality of pads 202 and each of the floating pads of the rear plurality of pads 204 is supported through its respective hinged connection 232. In this respect, each of the plurality of pads 200 and each of its respective hinged connections 232 is of sufficient structural strength for the front plurality of pads 202 and the rear plurality of pads 204 to keep their respective shapes (i.e. not fold upon themselves) when the helmet 100 is not being worn.

Referring to FIGS. 12-16, the pads of the plurality of pads 200 are spaced from each other so as to provide apertures 228 for ventilation of the head of the wearer when the helmet is being worn. In this respect, the majority of the apertures 228 between the pads are arranged to provide access to the apertures 128 of the shell 102.

Figure 25:
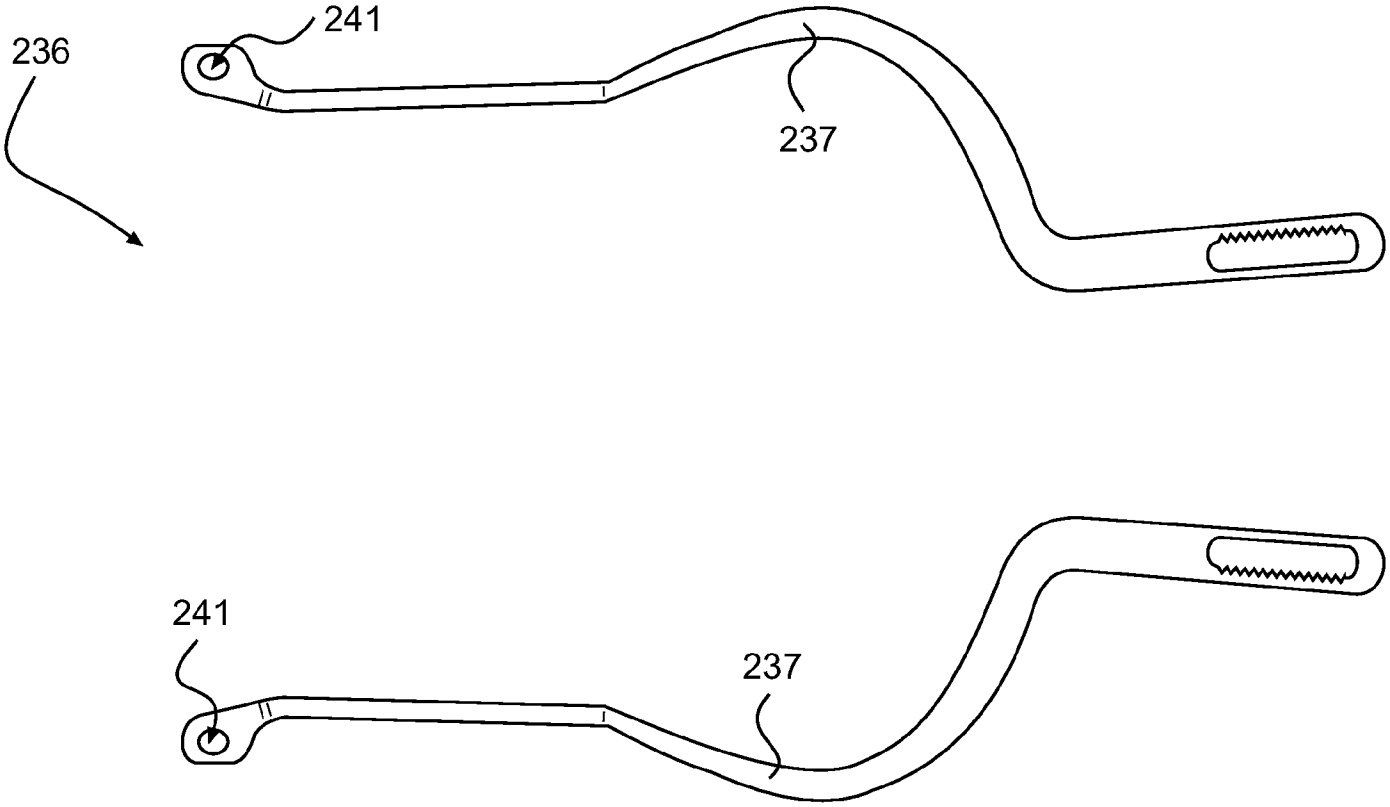
FIG. 25 is a view of an elongated member indicated by a reference numeral 236 in FIG. 1.
Figure 26:
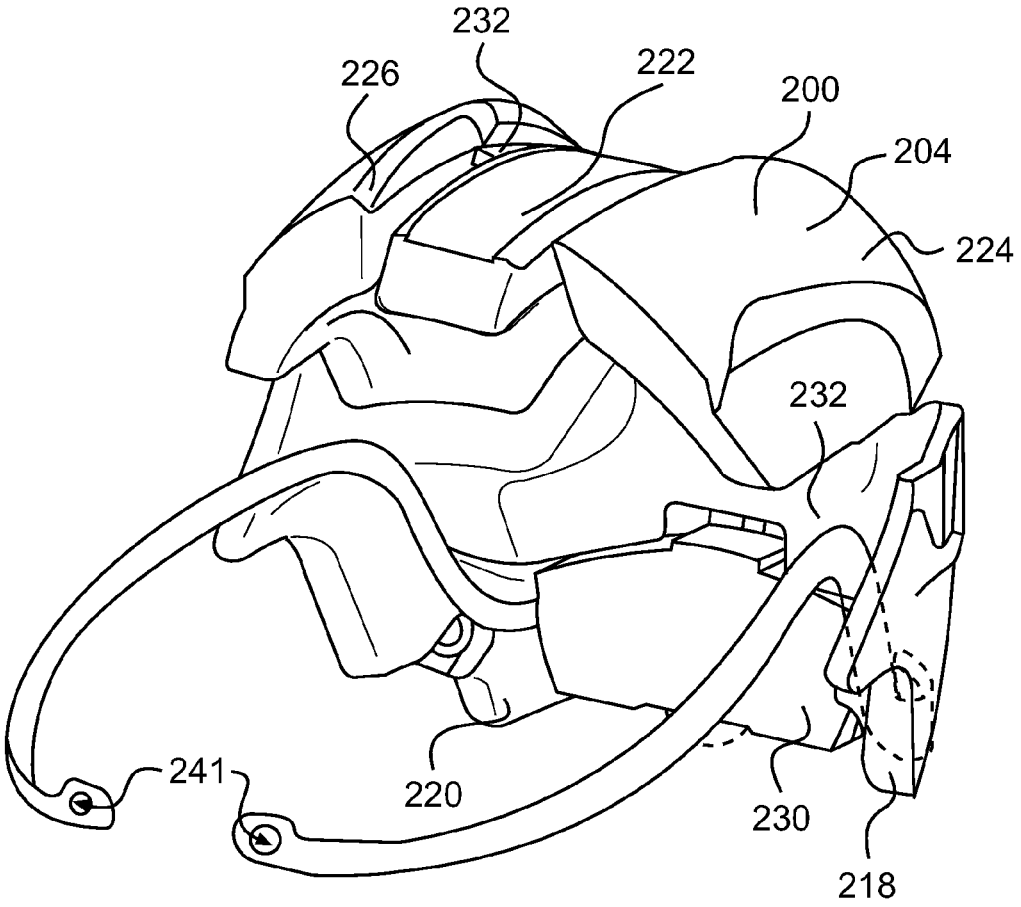
FIG. 26 is a front left perspective view of the rear liner portion of FIG. 12 shown with the elongated member of FIG. 25.

Still referring to FIGS. 12-16, the liner 104 also has an encircling portion 234 which encircles most of the frontal portion 500, the left 502 and the right 504 temporal portions and the occipital portion 508 of the head of the wearer when the helmet is being worn. The encircling portion 234 includes an elongated member 236 (FIG. 25), fixed pad 206, and floating pads being the left temporal pad 208, the right temporal pad 210 and the occipital pad 230. In the present embodiment, elongated member 236 is a composed of two generally non-extendable straps 237 shown in FIG. 25 which encircle most of the encircling portion 234. It is contemplated that in other embodiments the non-extendable straps can be replaced by any elongated member known in the art which may be non-extendable or extendable to the extent of performing the functions intended by elongated member 236 and which are described herein. It is also contemplated that elongated member 236 may be composed of a single strap encircling the encircling portion 234.

Figure 8:
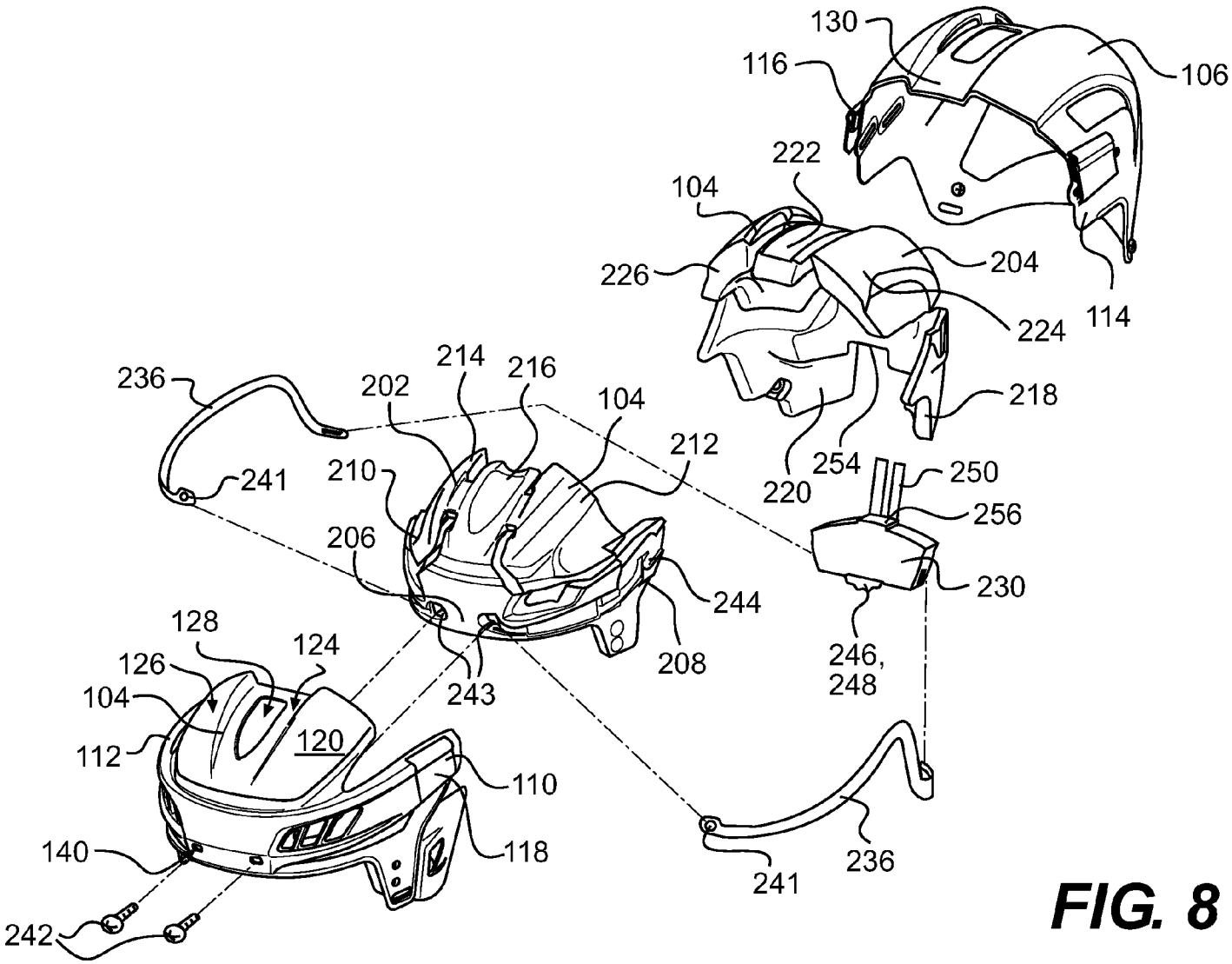
FIG. 8 is a front left exploded view of the ice hockey helmet of FIG. 1.

Elongated member 236 is connected to the pads 206, 208, 210, and 230. Elongated member 236 is inserted into the left side 238 and the right side 240 of the occipital pad 230 as shown. (In some embodiments, an elongated member is inserted into the left side and the right side of an occipital pad or adjustment mechanism as described in US Patent Application Publication No. US2007/0266481, the entirety of which is incorporated herein by reference.) Elongated member 236 is also attached to the interior shell surface 122 via fasteners 242 (shown best in FIG. 1) which are disposed in apertures 140 of front shell portion 106 as shown in FIG. 8 and in apertures 241 in each of the straps 237.

In this particular embodiment, the elongated member 236 is attached to the fixed pad 206 via fasteners 242 which are disposed into apertures 243 of fixed pad 206 and into apertures 241 of the each of the straps 237.

Further, as shown in FIGS. 12-14, and 16, the elongated member 236 is disposed in the channel 244 which passes through the pads 206, 208 and 210. The channel 244 prevents elongated member 236 from becoming displaced with respect to the pads 206, 208 and 210 when the helmet is being worn, especially during a game of hockey and when the player turns his/her head strongly or abruptly.

The elongated member 236 is operatively connected to an adjustor 246 which can be partly disposed in occipital pad 230. The adjustor 246 has a dial 248 which may be turned in a predetermined direction in order to constrict or extend the elongated member 236. It is contemplated that in other embodiments the dial 248 may be replaced by any of a bar, a clamp and any other suitable adjustor which can control the constriction or extension of elongated member 236. The adjustor 246 will not be described in more detail, as an adequate example of the adjustor 246 is disclosed in the aforementioned '481 US Publication.

Description of the Liner—Manufacture

Each of the plurality of pads 200 can be of a dual layer construction and can include: a layer of foam (to provide for shock-absorption and/or comfort) such as, for example, expanded polypropylene (EPP), expanded polystyrene (EPS), ethyl vinyl acetate (EVA), or combinations thereof; and an optional thin layer of soft foam (to provide for comfortably supporting the liner on the head of the wearer) such as, for example, polyvinyl chloride (PVC), polyurethane (PU), polyethylene (PE), EVA, or combinations thereof. It is also contemplated that in other embodiments additional layers and/or structures could be added. Each of the layers is formed by conventional means such as, for example, molding (e.g., injection or compression), casting, extrusion, or cutting from foam stock (e.g., die cutting). In some embodiments, EPP or EPS layers can be made by steam molding polypropylene or polystyrene. After forming, the layers are assembled through conventional means.

Each of hinged connections 232 (except for hinged connection 232 between floating pad 222 and occipital pad 230) is made of the foam of the pads for ease of manufacturing (so that the majority of the liner 104 may be made as two foam parts). It should be understood that in other embodiments the hinged connections 232 may be made of any other suitable conventional material. For example, in some embodiments, hinged connections 232 can include mechanical hinges such as plastic or metal hinges.

The hinged connection 232 between floating pad 222 and occipital pad 230 consists of two members 250 (e.g., made of polycarbonate (PC); high density polyethylene (HDPE); acrylonitrile butadiene styrene (ABS); polyurethane (PU); nylon; polypropylene (PP); a reinforcing material such as glass, carbon, or aramid fiber; metal; and combinations thereof) extending between floating pad 222 and occipital pad 230. Particularly, two members 250 extend from the lower center portion 254 of the pad 222 into the upper center portion 256 of the occipital pad 230

The elongated member 236 can be made of two pieces of flexible, generally non-extendable plastic or other flexible material. In some embodiments, elongated member 236 can comprise polyethylene (PE), polyvinyl chloride (PVC), polyurethane (PU), nylon, polypropylene (PP), metal, fibers (such as textiles) and combinations thereof. It is contemplated that in other embodiments any other suitable flexible material known to a person of skill in the art may be used for manufacturing of the elongated member 236.

Description of the Functioning of the Liner

Figure 4:
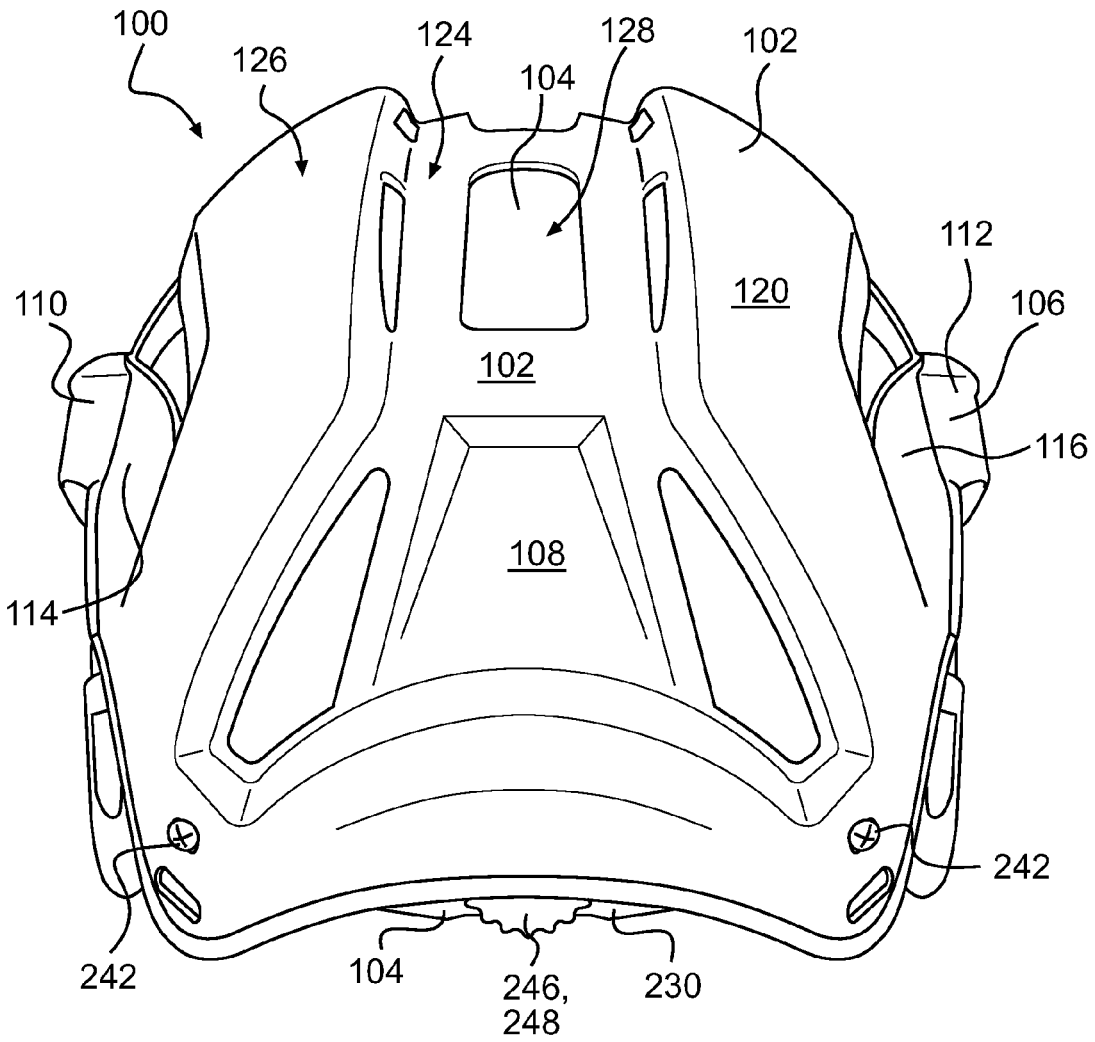
FIG. 4 is a rear elevation view of the ice hockey helmet of FIG. 1.

Referring to FIGS. 1 and 4, it may be seen that the liner 104 is attached to interior shell surface 122 of the shell 102 via the attachment of fixed pads 206, 218 and 220 to the shell by fasteners 242, thus at least a portion of fixed pads 206, 218 and 220 are not materially freely movable with respect to the shell 102 (i.e. certain portions of the pads, especially those far from the fasteners 242, are capable of slight movement).

Figure 19:
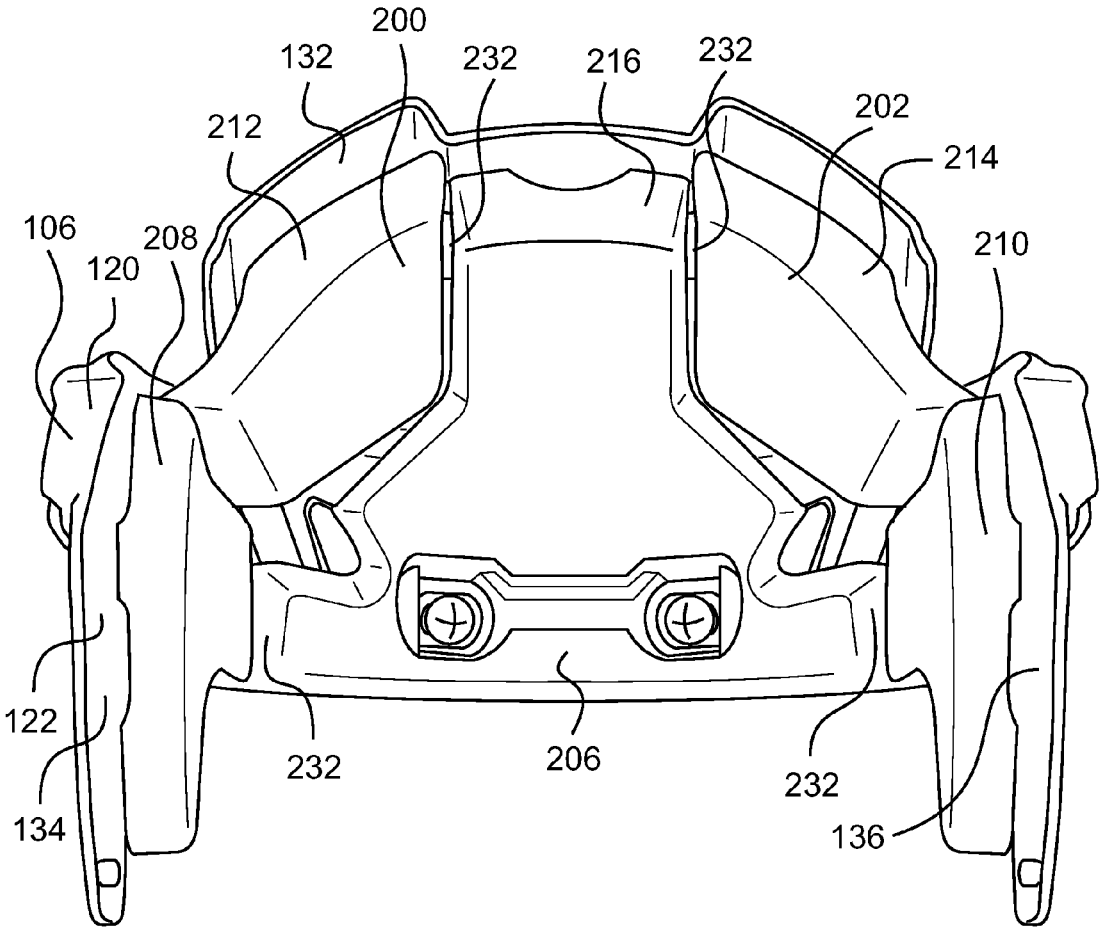
FIG. 19 is a rear elevation view of the front liner part of FIG. 17 disposed in juxtaposition with the front shell part of FIG. 11, showing a plurality of floating pads in their second positions.

Floating pads 212, 214, 216, 222, 224 and 226 are all biased away from the interior shell surface 122 due to the construction of their respective hinged connections 232 to that effect. In this respect, when the helmet 100 is not being worn, each of the plurality of floating pads 212, 214, 216, 222, 224 and 226 is in its second position away from the interior shell surface 122, as shown in FIGS. 19 and 21.

Figure 20:
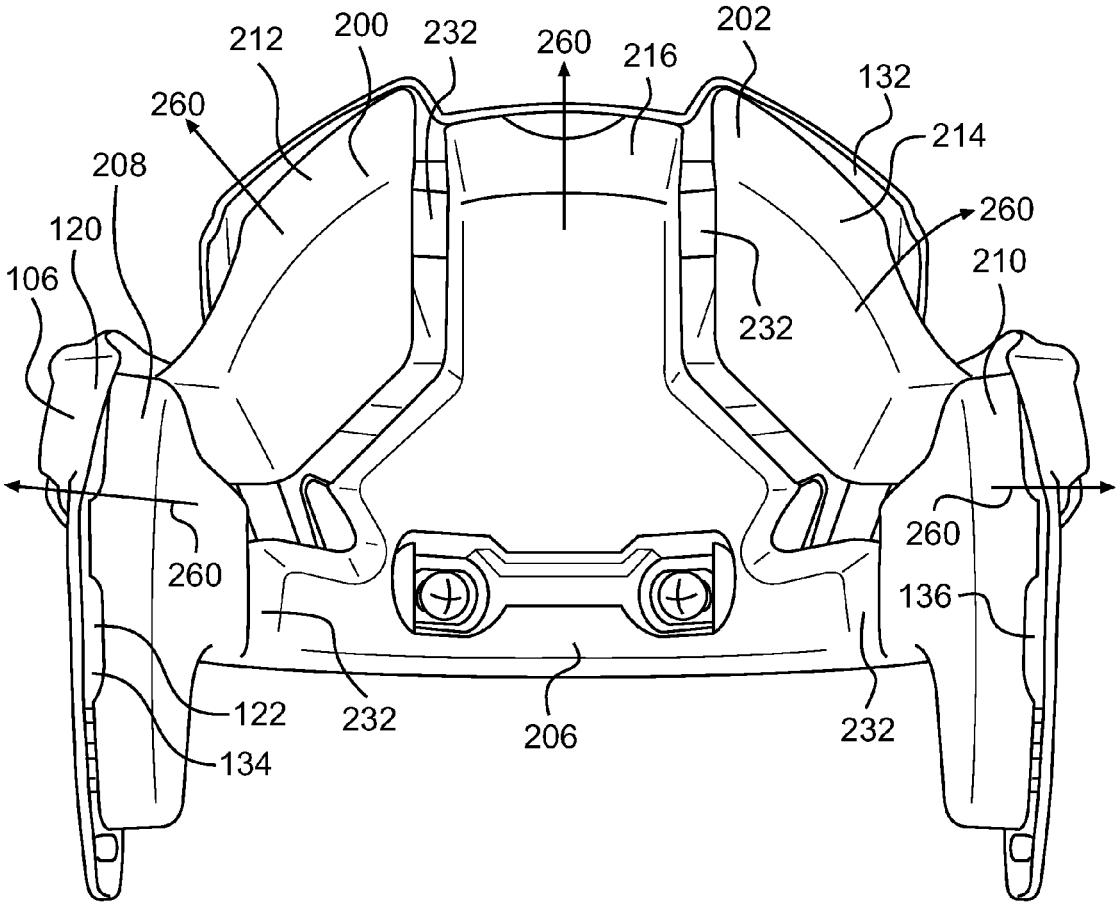
FIG. 20 is a rear elevation view of the front liner part of FIG. 17 disposed in juxtaposition with the front shell part of FIG. 11, showing the plurality of floating pads in their first positions.
Figure 22:
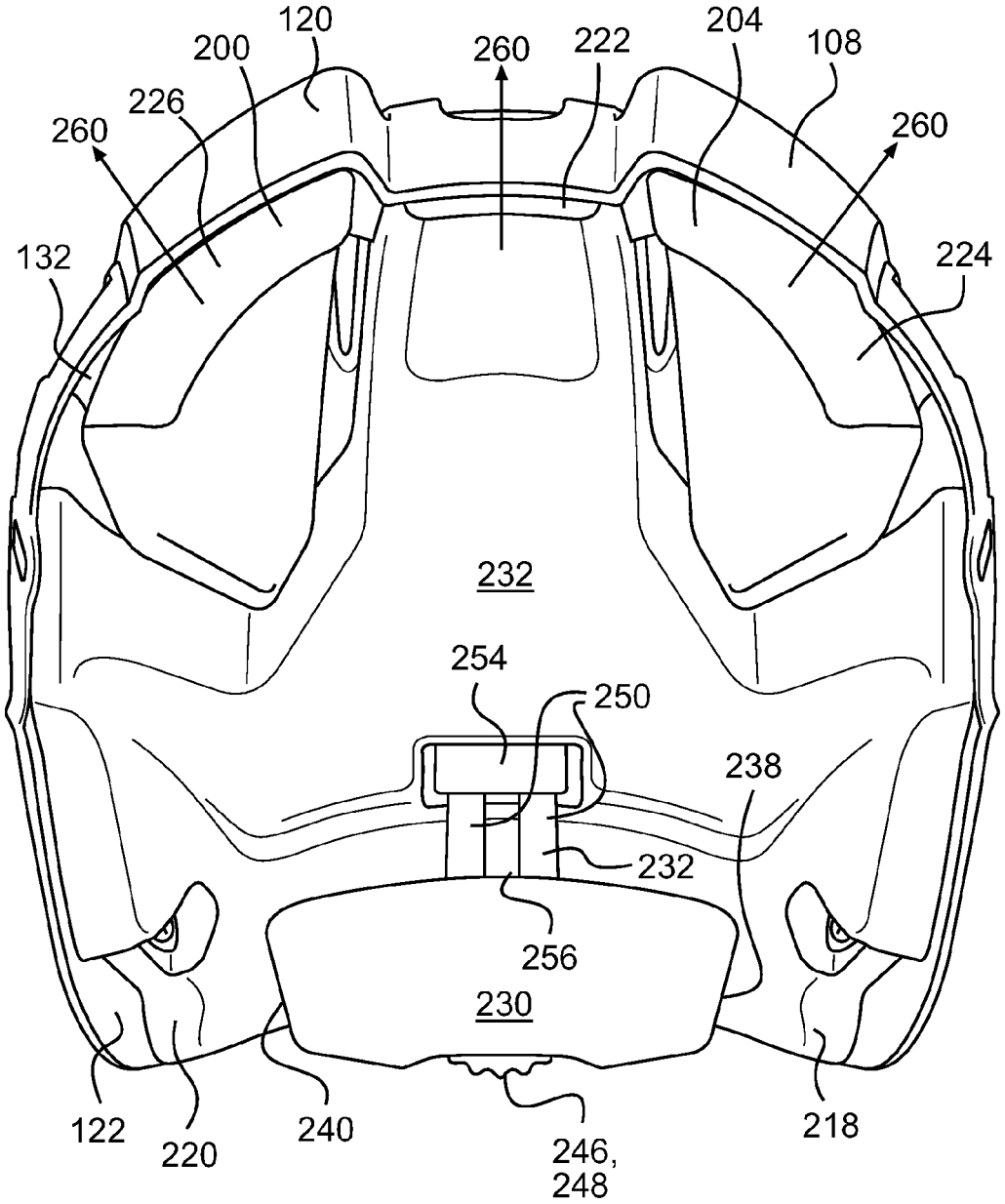
FIG. 22 is a front elevation view of the rear liner portion of FIG. 12 disposed in juxtaposition with the rear shell portion of FIG. 11, showing the plurality of floating pads in their first positions.
Figure 23:
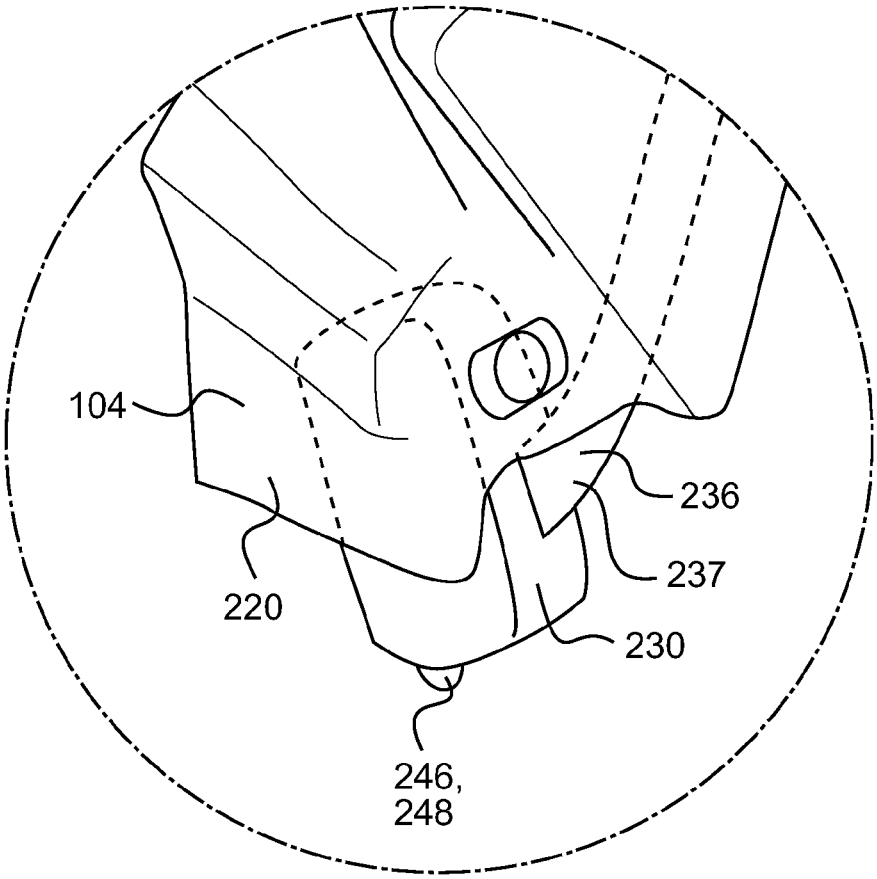
FIG. 23 is a close-up right side elevation view of the portion of the rear liner portion indicated by the circle A in FIG. 16, showing an occipital pad in a fourth position, a close-up left side elevation view being a mirror image thereof.
Figure 24:
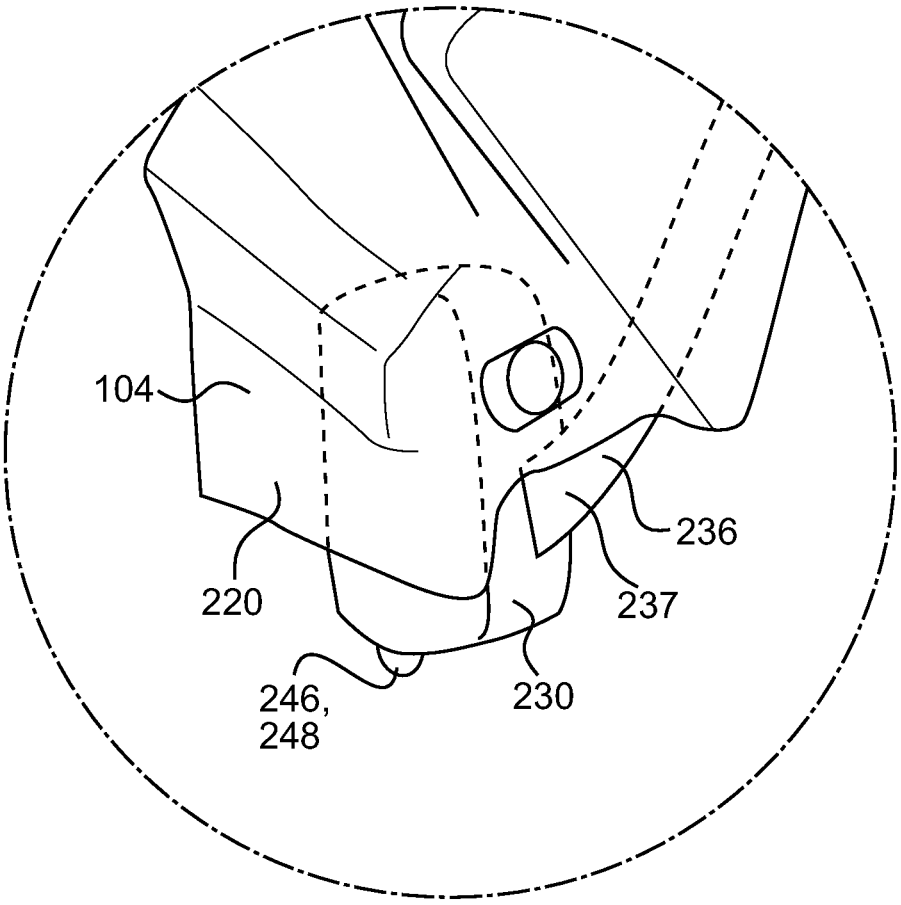
FIG. 24 is a close-up right side view of the portion of the rear liner portion indicated by the circle A in FIG. 16, showing an occipital pad in a fourth position, a close-up left side elevation view being a mirror image thereof.

When the head of the wearer is inserted into the helmet 100 (not shown), each of the plurality of floating pads 212, 214, 216, 222, 224 and 226 is displaced by the head of the wearer towards their respective first positions towards the interior shell surface 122 which are shown in FIGS. 20 and 22. The direction of the movement of the floating pads 212, 214, 216, 222, 224, 224 and 226 is indicated by the arrows 260 in that Figure. Given that the shape of human heads vary between humans (and that the shape of any individual human head is not a perfect geometric object (e.g. a sphere)) the amount of movement of each of the floating pads 212, 214, 216, 222, 224, and 226 will likely differ for any given individual and will almost certainly differ between individuals.

It is even contemplated that there may be a case where the head of the wearer is small or of irregular shape, thus, not all of the floating pads 212, 214, 216, 222, 224, and 226 will be displaced by the head to towards their first position and one or more will remain in their second position.

Figure 21:
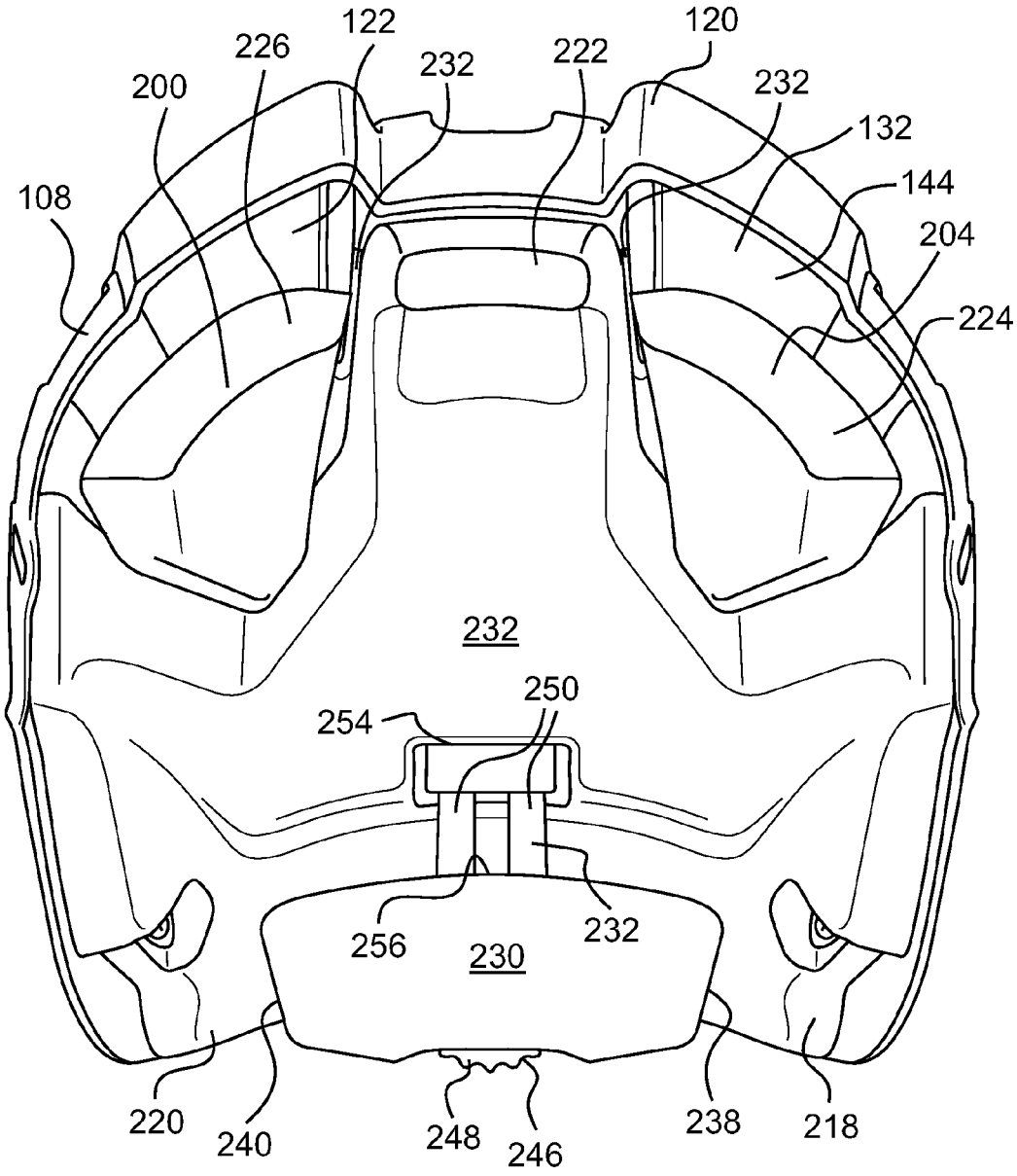
FIG. 21 is a front elevation view of the rear liner part of FIG. 12 disposed in juxtaposition with the rear shell portion of FIG. 11, showing a plurality of floating pads in their second positions.

Further, when the wearer inserts his head into the helmet 100, some of the floating pads of the floating pads 212, 214, 216, 222, 224, 226 may be displaced entirely to their first position and will abut the interior shell surface 122 as shown in FIGS. 20 and 21.

Figure 27:
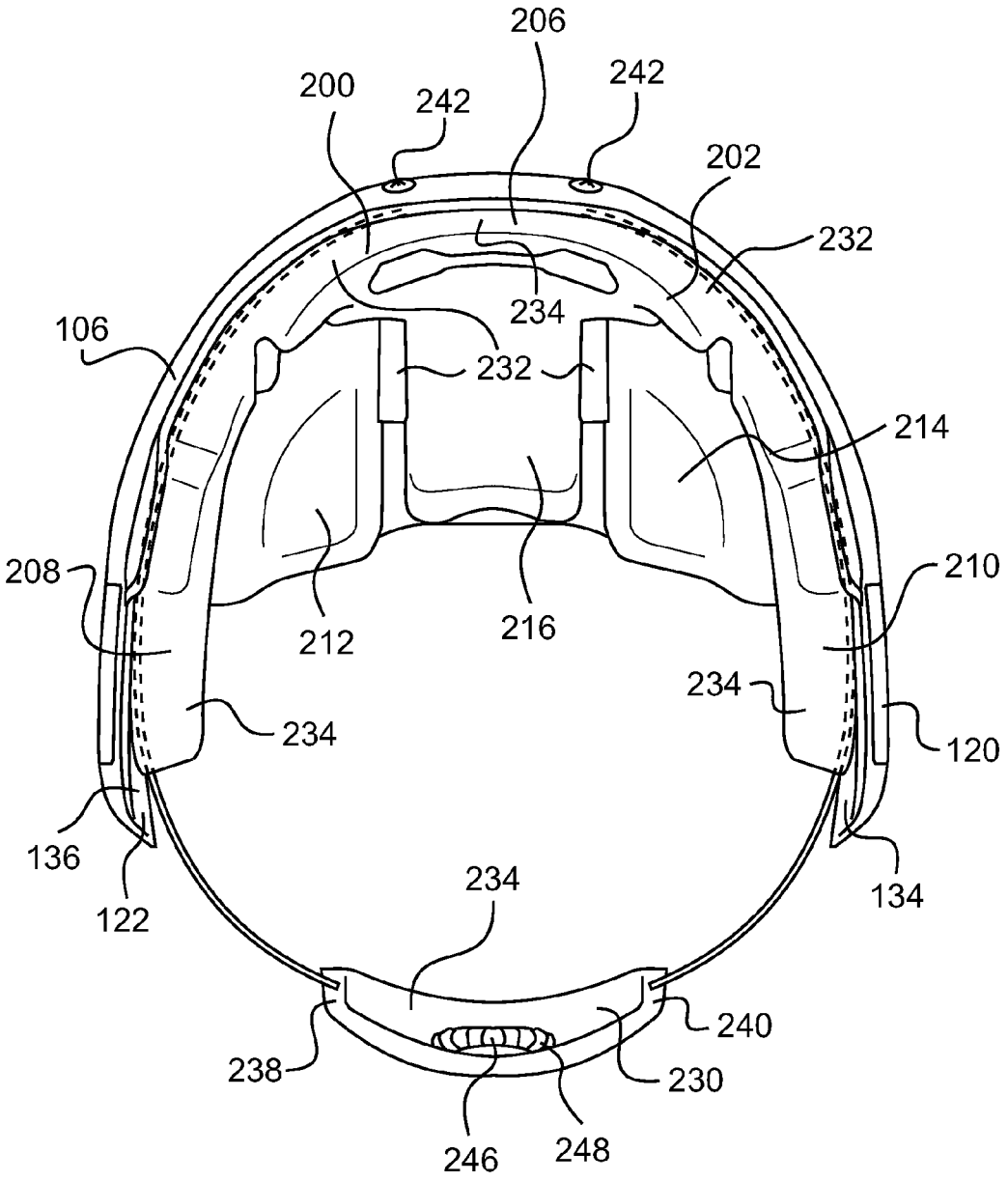
FIG. 27 is a bottom plan view of the helmet of FIG. 1 showing the elongated member of FIG. 25 and an encircling portion indicated by a reference numeral 234 as being unconstricted with the pads in their first position.
Figure 28:
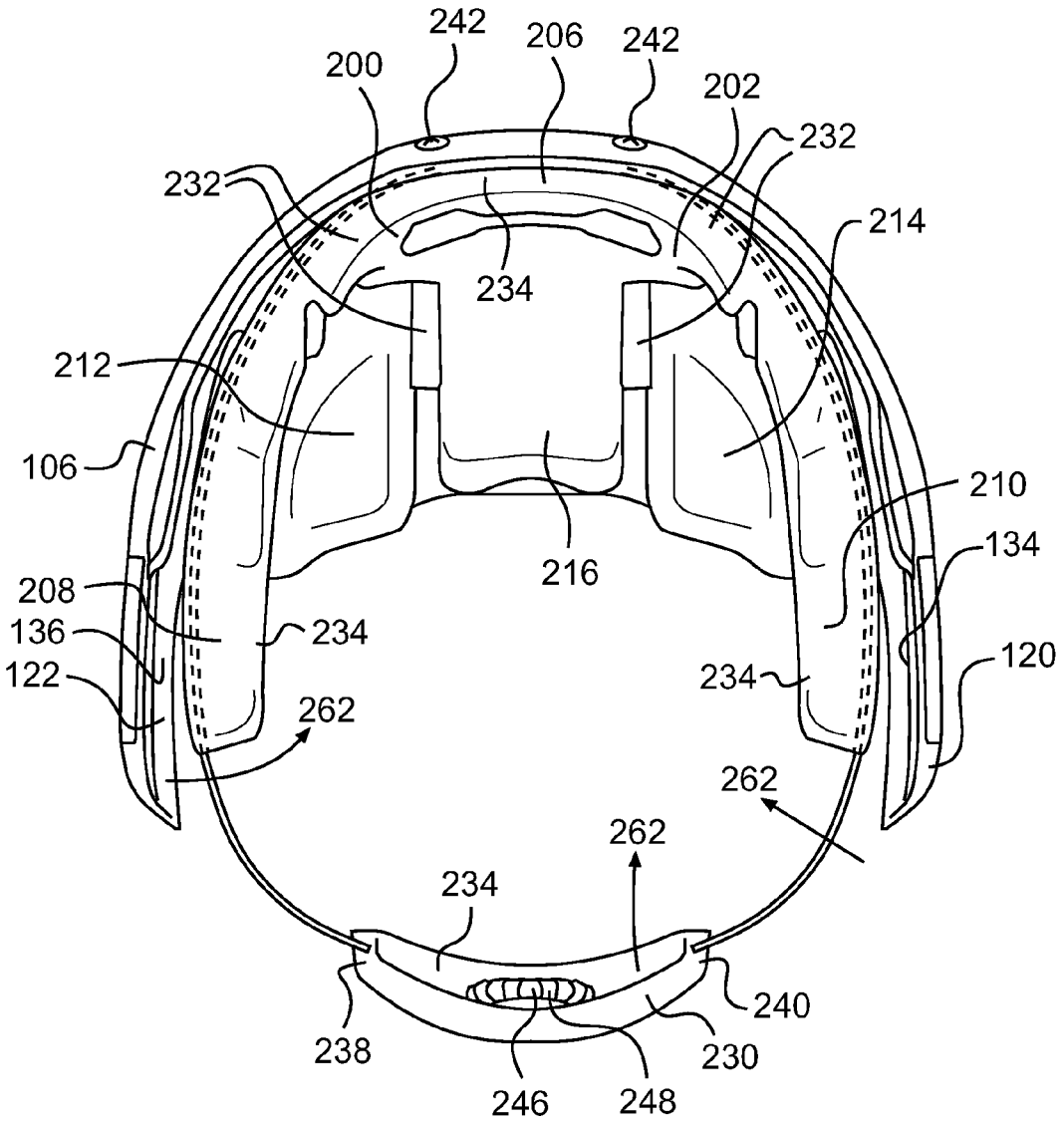
FIG. 28 is a bottom plan view of the helmet of FIG. 1 showing the elongated member of FIG. 25 and the encircling portion indicated by a reference numeral 234 as being constricted with the pads in their second position.

In another aspect, referring to FIGS. 27 and 28, once the helmet 100 is on the head of the wearer the encircling portion 234 can be constricted by constricting the elongated member 236 via the adjustor 246, thus tightening the left temporal pad 208, the right temporal pad 210 and the occipital pad 230 around the head of the wearer. This adjustment of the encircling portion 234 may follow the following steps. First, the wearer inserts his head into the helmet 100. The pads 208 and 210 may move towards the interior shell surface 122 as displaced by the head of the wearer if the head of the wearer is large enough to cause such a displacement. Secondly, if the wearer decides to tighten or loosen the encircling portion 234 around his head, he will turn the dial 248 of the adjustor 246 in a predetermined direction and the elongated member 236 will either constrict or loosen the encircling portion 234 around the head of the wearer as the case may be. If the elongated member 236 is constricted, than the left temporal pad 208, the right temporal pad 210 and the occipital pad 230 will move away from the interior shell surface 122 in the direction shown by the arrows 262 in FIG. 27. When the wearer is satisfied by the tightness of the grip of the encircling portion 234 around his head, he stops turning the dial 248 and the left temporal pad 208, the right temporal pad 210 and the occipital pad 230 will stop their movement in a position away from the interior shell surface 122 as shown FIG. 28.

To loosen the encircling portion 234 around the head, the wearer may turn the adjustor in a direction opposite to the direction for tightening of the encircling portion 234 and the left temporal pad 208, the right temporal pad 210 and the occipital pad 230 will move towards the interior shell surface 122 respectively thus loosening the encircling portion 234 around the head of the wearer.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

The invention claimed is:

1. A helmet comprising:

a rigid shell having an interior shell surface defining a cavity within the shell for receiving a head of a wearer of the helmet and an upper shell portion covering at least a majority of a frontal portion and parietal portions of the head of the wearer when the helmet is being worn; and an adjustable liner connected to the shell, the liner including a first plurality of floating pads located in the cavity in juxtaposition with the upper shell portion of the helmet and at least one fixed pad connected to the shell such as to prevent inward or outward movement of the at least one fixed pad with respect to the interior shell surface, each of the first plurality of floating pads being supported by a corresponding hinged connection located between the respective floating pad and one of the at least one fixed pad and directly connected to the respective floating pad and to the one of the at least one fixed pad, each of the first plurality of floating pads being movable about the corresponding hinged connection with respect to the interior shell surface between a first position near the interior shell surface and a second position further away from the interior shell surface than the first position, each of the first plurality of floating pads being biased towards its second position only by the corresponding hinged connection with an amount of force that can be overcome by the wearer inserting his head into the helmet, an act of the wearer inserting his head into the helmet causing each of the first plurality of floating pads to move from its second position towards its first position while remaining biased against the head of the wearer to assist the liner in conforming to the head of the wearer while supporting the helmet on the head of the wearer, each hinged connection consisting of a hinge formed by having the respective floating pad and the one of the at least one fixed pad made of a single piece or a mechanical hinge extending between the respective floating pad and the one of the at least one fixed pad, each hinged connection being of sufficient structural strength to retain its respective floating pad in the second position when the helmet is not worn.

2. The helmet of claim 1, wherein two of the first plurality of floating pads are hingedly interconnected.

3. The helmet of claim 2, wherein the hinged interconnection between the two of the first plurality of floating pads is itself movable with respect to the interior shell surface independently of movement of the two of the first plurality of floating pads relative to the interconnection.

4. The helmet of claim 3, wherein at least one pad of the first plurality of floating pads is movable between its second position and its first position independently of movement of at least one other pad of the first plurality of floating pads from its second position to its first position.

5. The helmet of claim 1, wherein each of the first plurality of floating pads is attached to the shell solely via at least one of the hinged connections to the at least one fixed pad.

6. The helmet of claim 1, wherein at least some of the first plurality of floating pads are movable between their second position and their first position independently of movement of others of the first plurality of floating pads from their second position to their first position.

7. The helmet of claim 1, wherein the helmet is supported on the head of the wearer at least by a portion of some of the first plurality of floating pads abutting the interior shell surface after the movement caused by the act of the wearer inserting his head into the helmet.

8. A helmet comprising:

a rigid shell having an interior shell surface defining a cavity within the shell for receiving a head of a wearer of the helmet, an upper shell portion covering at least a majority of a frontal portion and parietal portions of the head of the wearer when the helmet is being worn, a left side shell portion covering at least a majority of a left temporal portion of the head of the wearer when the helmet is being worn, a right side shell portion covering at least a majority of a right temporal portion of the head of the wearer when the helmet is being worn, and a lower rear shell portion covering at least a majority of an occipital portion of the head of the wearer when the helmet is being worn; and an adjustable liner connected to the shell, the liner including a first plurality of floating pads located in the cavity in juxtaposition with the upper shell portion of the helmet, each of the first plurality of floating pads being movable with respect to the interior shell surface between a first position near the interior shell surface and a second position further away from the interior shell surface than the first position, a second plurality of pads including a left temporal floating pad located in the cavity in juxtaposition with the left shell portion of the helmet, a right temporal floating pad located in the cavity in juxtaposition with the right shell portion of the helmet, and an occipital pad in juxtaposition with the lower rear shell portion of the helmet, at least the left temporal floating pad and the right temporal floating pad being movable with respect to the interior shell surface between a first position near to the interior shell surface and a second position further away from the interior shell surface than the first position; and an encircling portion encircling the frontal portion, the left temporal portion, the right temporal portion and the occipital portion of the head of the wearer when the helmet is being worn, the encircling portion including at least the left temporal floating pad, the right temporal floating pad, the occipital pad and an elongated member operatively connected with at least the left temporal floating pad and the right temporal floating pad such that constriction of the encircling portion includes at least the left temporal floating pad and the right temporal floating pad moving from their respective first positions towards their respective second positions to assist in causing the liner to conform to the head of the wearer.

9. The helmet of claim 8, wherein constriction of the elongated member causes constriction of the encircling portion.

10. The helmet of claim 8, wherein the elongated member completely encircles the head of the wearer when the helmet is being worn.

11. The helmet of claim 8, wherein the elongated member is attached to at least the left temporal floating pad and the right temporal floating pad.

12. The helmet of claim 8, wherein the elongated member is attached to the interior shell surface.

13. The helmet of claim 9, further comprising an adjustor having one of a dial, a bar, and a clamp operatively connected to the elongated member for causing constriction of the elongated member.

14. The helmet of claim 13, wherein the elongated member is further operatively connected with the occipital pad and constriction of the encircling portion further includes the occipital pad moving from a third position to a fourth position to assist in causing the liner to conform to the head of the wearer.

15. The helmet of claim 14, wherein the adjustor is connected to at least the occipital pad.

16. The helmet of claim 8, wherein the elongated member is further operatively connected with the occipital pad and constriction of the encircling portion further includes the occipital pad moving from a third position to a fourth position to assist in causing the liner to conform to the head of the wearer.

17. The helmet of claim 8, wherein the elongated member comprises a first portion attached to the interior shell surface of the upper shell portion at a first point and at a second portion discontinuous from the first portion attached to the interior shell surface of the upper shell portion a second point spaced apart from the first point.

18. The helmet of claim 17, wherein the encircling portion further comprises an adjustor having one of a dial, a bar, and a clamp operatively connected to each of the portions of the elongated member, the adjustor for causing constriction of the elongated member.

19. The helmet of claim 1, further comprising a second floating pad supported by a second hinged connection located between the second floating pad and one of the at least one fixed pad and including two members directly connected to the second floating pad and to the one of the at least one fixed pad, the second floating pad being movable about the second hinged connection between a first position near the interior shell surface and a second position further away from the interior shell surface than the first position, the second floating pad being biased towards its second position by the second hinged connection, the second hinged connection being of sufficient structural strength to retain the second floating pad in the second position when the helmet is not worn.

20. The helmet of claim 19, wherein the two members include a material selected from the group consisting of polycarbonate, high density polyethylene, acrylonitrile butadiene styrene, polyurethane, nylon, polypropylene, metal, and combinations thereof.

21. The helmet of claim 1, wherein each hinged connection for the first plurality of floating pads is made of the same foam as the respective floating pad.

22. The helmet of claim 1, wherein at least some of the hinged connections include the mechanical hinge, the mechanical hinge being made of plastic or metal.

* * * * *